US008671634B2

(12) United States Patent
Morcous et al.

(10) Patent No.: US 8,671,634 B2
(45) Date of Patent: Mar. 18, 2014

(54) SHALLOW FLAT SOFFIT PRECAST CONCRETE FLOOR SYSTEM

(75) Inventors: George Morcous, Omaha, NE (US); Maher Tadros, Omaha, NE (US)

(73) Assignee: Board of Regents of the University of Nebraska, Lincoln, NE (US)

( * ) Notice: Subject to any disclaimer, the term of this patent is extended or adjusted under 35 U.S.C. 154(b) by 55 days.

(21) Appl. No.: 13/434,359

(22) Filed: Mar. 29, 2012

(65) Prior Publication Data

US 2013/0074430 A1 Mar. 28, 2013

Related U.S. Application Data

(60) Provisional application No. 61/468,642, filed on Mar. 29, 2011.

(51) Int. Cl.
*E04B 1/00* (2006.01)

(52) U.S. Cl.
USPC ..... 52/252; 52/258; 52/259

(58) Field of Classification Search
USPC ..... 52/79.1, 252, 264, 258, 259, 309.12, 52/602
See application file for complete search history.

(56) References Cited

U.S. PATENT DOCUMENTS

| | | | | | |
|---|---|---|---|---|---|
| 667,871 | A * | 2/1901 | Ellinger | 52/250 |
| 919,714 | A * | 4/1909 | Graham | 52/252 |
| 1,011,195 | A * | 12/1911 | Harry | 52/252 |
| 2,154,390 | A * | 4/1939 | Akers | 52/371 |
| 3,017,972 | A * | 1/1962 | Saxe | 403/189 |
| 3,613,325 | A * | 10/1971 | Yee | 52/236.8 |
| 4,630,412 | A * | 12/1986 | Engstrom et al. | 52/1 |
| 4,945,695 | A * | 8/1990 | Majurinen | 52/252 |
| 5,628,717 | A * | 5/1997 | Van Haag | 492/7 |
| 6,625,943 | B1 * | 9/2003 | Renner | 52/251 |
| 7,954,291 | B2 * | 6/2011 | Cretti | 52/309.16 |
| 2001/0003234 | A1 * | 6/2001 | Van Doren | 52/251 |

* cited by examiner

*Primary Examiner* — Brian Glessner
*Assistant Examiner* — Adam Barlow
(74) *Attorney, Agent, or Firm* — Davis, Brown, Koehn, Shors & Roberts, P.C.; Sean D. Solberg

(57) ABSTRACT

A precast concrete floor system that eliminates the need for column corbels and beam ledges while being very shallow. The main advantages of the present system include a span-to-depth ratio of 30, a flat soffit, economy, consistency with prevailing erection techniques, and fire and corrosion protection. The present system consists of continuous precast columns, prestressed rectangular beams, hollow-core planks, and cast-in-place composite topping. Testing results have indicated that a 12 inch deep flat soffit precast floor system has adequate capacity to carry gravity loads (including 100 psf live load) in a 30 ft×30 ft bay size. Testing has also shown that shear capacity of the ledge-less hollow-core-beam connections can be accurately predicted using the shear friction theory.

18 Claims, 24 Drawing Sheets

SHALLOW FLAT SOFFIT PRECAST CONCRETE FLOOR SYSTEM

CROSS-REFERENCE TO RELATED APPLICATIONS

This application claims priority to U.S. Patent Application Ser. No. 61/468,642, filed Mar. 29, 2011, which is incorporated herein in its entirety by this reference.

BACKGROUND OF THE INVENTION

The present invention relates generally to precast concrete floor systems and, more specifically, to a precast concrete floor system that has a shallow flat soffit and uses no corbels to reduce the floor height while maximizing useable space.

Conventional hollow-core floor systems consist of hollow-core planks supported by inverted-tee (IT) precast prestressed concrete beams, which are, in turn, supported on column corbels or wall ledges. These floor systems provide a rapidly constructed solution to multi-story buildings that is economical, fire-resistant, and with excellent deflection and vibration characteristics. The top surface of hollow-core floor systems can be a thin non-structural cementitious topping or at least 2 inch thick concrete composite topping that provides a leveled and continuous surface. Despite the advantages of conventional precast hollow-core floor systems, they have the two main limitations of a low span-to-depth ratio and the presence of floor projections, such as column corbels and beam ledges. For a 30 ft bay size, conventional precast hollow-core floor system would require a 28 inch deep IT plus a 2 inch topping, for a total floor depth of 30 inches, which results in a span-to-depth ratio of 12 (PCI, 2010). In addition, this floor would have a 12 inch deep ledge below the hollow-core soffit and a 16 inch deep column corbel below the beam soffit.

On the other hand, post-tensioned cast-in-place concrete slab floor systems can be built with a span-to-depth ratio of 45 and flat soffit, which results in a structural depth of 8 inches for the 30 ft bay size (PTI, 2006). If the structural depth of precast floor systems can come close to that of post-tensioned cast-in-place concrete slab system, then precast concrete systems could be very favorable due to their rapid construction and high product quality. Reducing the depth of structural floor results in reduced floor height, which in turn makes savings in architectural, mechanical and electrical (AME) systems and may allows for additional floors for the same building height. The cost of AME systems is about 75 to 80% of the total initial and operation cost, and any small savings in these systems would have a significant impact on the building life cycle cost.

Low, et al. (1991 and 1996) developed a shallow floor system for multi-story office buildings. The system consists of hollow-core planks, 8 ft wide and 16 inch deep prestressed beams, and single-story precast columns fabricated with full concrete cavities at the floor level. The column reinforcement in this patented system is mechanically spliced at the job site to achieve the continuity (Tadros and Low, 1996). The beam weight and the complexity of the system design and detailing were discouraging to producers.

Thompson and Pessiki, (2004) developed a floor system of inverted tees and double tees with openings in their stems to pass utility ducts. This floor system is appropriate and economical for parking structures as it does not provide either shallow floor or flat soffit required for residential and office buildings.

Hanlon, et al. (2009) developed a total precast floor system for the construction of the nine-story flat-slab building. This system consists of precast concrete stair/elevator cores, prestressed concrete beam-slab units, prestressed concrete rib-slab floor elements; variable-width beam slab; and integrated precast concrete columns with column capital. The need for special forms to fabricate these components and the need for high capacity crane for erection are the main limitations of this system.

Composite Dycore Office Structures (1992) developed the Dycore floor system that consists of shallow soffit beam, Dycore floor slabs, and continuous cast-in-place/precast columns with block outs at the beam level. In this system, precast beams and floor slabs act primarily as stay-in-place forms for major cast-in-place operations required to complete the floor system, which is costly and time consuming.

Simanjuntak, J. H. (1998) developed a shallow ribbed slab configuration without corbels. This is accomplished by threading high tensile steel wire rope through pipes imbedded in the floor system and holes in the columns. The main drawback of that system is the need for false ceiling to cover the unattractive slab ribs.

Wise, H., H. (1973) introduced a method for building reinforced concrete floors, and roofs employing composite concrete flexural construction with little formwork. The bottom layer of the composite concrete floor is formed by using thin prefabricated concrete panels laid side by side in place with their ends resting on temporary or permanent supports. The panels are precast with one or more lattice-type girders or trusses extending lengthwise from each panel having their bottom chords firmly embedded in the panel and with the webbing and top chords extending above the top surface of the panel. The main drawback of that system is the need for shoring during construction, in addition to the limitations of the panel dimensions.

Filigree Widesslap System was presently used under the name of OMNIDEC (Mid-State Filigree Systems, Inc. 1992). It consists of reinforced precast floor panels that serve as permanent formwork. The panels are composite with cast-in-place concrete and contain the reinforcement required in the bottom portion of the slab. They also contain a steel lattice truss, which projects from the top of the precast unit. One of the main advantages for this system is a flat soffit floor which does not required a false ceiling. However, this system requires extensive techniques to produce (Pessiki, et al. 1995).

Bellmunt and Pons (2010) developed a new flooring system which consists of a structural grid of concrete beams with expanded polystyrene (EPS) foams in between. The grid has beams in two directions every 32 inches. The floor is finished with a light paving system on top and a light ceiling system underneath. This system has many advantages, such as lightweight, flat soffit, and thermal insulation. However, some of its disadvantages include the floor thickness, unique fabrication process of EPS forms due to the special connections required.

The Deltabeam (Peikko Group, Peikko News (2010)), is a hollow steel-concrete composite beam made from welded steel plates with holes in the sides. It is completely filled with concrete after installation in site. Deltabeam acts as a composite beam with hollow-core, thin shell slabs, and in-situ casting. Deltabeam can have a fire class rating as high as R120 without additional fire protection. The Deltabeam height varies based on the required span. For a 32 ft span, the Deltabeam can be as shallow as 23 inch (21 inch deep beam+2 inch topping). Although this is 5 inches less than the precast/prestressed concrete inverted tee, it requires shoring for erection, adding shims to the base plate to rise up hollow core to match the level of the top plate, and additional fire protection operations if higher ratings are required.

Although the use of column corbels and beam ledges is the common practice in parking structures and commercial buildings, it is not aesthetically favourable in residential buildings, such as hotels. False ceiling is used in these applications to hide the unattractive floor projections, which results in reduced vertical clearance. Elimination of floor projections combined with shallow structural depth will improve the building aesthetics and overall economics.

SUMMARY OF THE INVENTION

The present invention provides a flat soffit shallow precast floor system for multi-story residential and office buildings. The system minimizes the limitations of existing precast floor systems with regard to span-to-depth ratio and floor projections, while maintaining speed of construction, simplicity, and economy. More specifically, the present system has a span-to-depth ratio of at least 30 to reduce the floor height and save in architecture, mechanical, and electrical costs. In addition, the present system eliminates the column corbels and beam ledges to provide additional space and flat soffit for residential and office buildings. Further, it consists of easy-to-produce and erect precast/prestressed components with minimal cast-in-place operations to ensure practicality, economy, quality, and speed of construction.

BRIEF DESCRIPTION OF THE DRAWINGS

FIGS. 11*a-d* are transverse cross-sectional views through two alternative beams, wherein FIG. 11*a* is a mid-span section of a beam provided with a shear key, FIG. 11*b* is a mid-span section of a beam provided with a hidden ledge, FIG. 11*c* is an end-span section of the beam of FIG. 11*a*, and FIG. 11*d* is an end-span section of the beam of FIG. 11*b*.

DETAILED DESCRIPTION OF PREFERRED EMBODIMENTS

The present floor system consists of precast continuous columns, precast rectangular beams, precast hollow core planks, and cast-in-place composite topping. The precast components can be easily fabricated using the facilities readily available to pre-casters in the United States.

The construction sequence consists of the following steps in order:

a) Multi-story continuous precast columns are erected and temporary corbels are installed at each floor level. The temporary corbels can be steel angles with stiffeners that are anchored to the column using high strength threaded rods through holes in the precast columns.

b) Precast rectangular beams are placed on temporary corbels. Steel angles are welded to the steel plates on top of beams and plates on column sides to stabilize beams during hollow-core erection.

c) Temporary beam ledges are installed for supporting hollow-core planks. These ledges can be steel tubes or angles anchored to the beam soffit using bolts and pre-installed coil inserts.

d) Hollow-core planks are placed on the temporary ledges for the entire floor.

e) Specially-shaped steel bars (called hat bars) are placed in hollow-core keyways. Also, beam continuity reinforcing bars are placed in beam recess and through the column opening.

f) Grout or flowable concrete is used to fill hollow-core keyways, beam recess, shear keys between hollow-core planks and beam sides, and gaps between beam ends and column sides.

g) An additional layer of beam continuity reinforcement is placed on top of the beam through the column opening and on each side of the column. Also, topping reinforcement is installed.

h) Cast-in-place topping is placed to provide leveled floor surface.

i) Temporary corbels and ledges are removed after the topping concrete reaches the required strength to provide a flat soffit.

EXAMPLE 1

Figure 1:
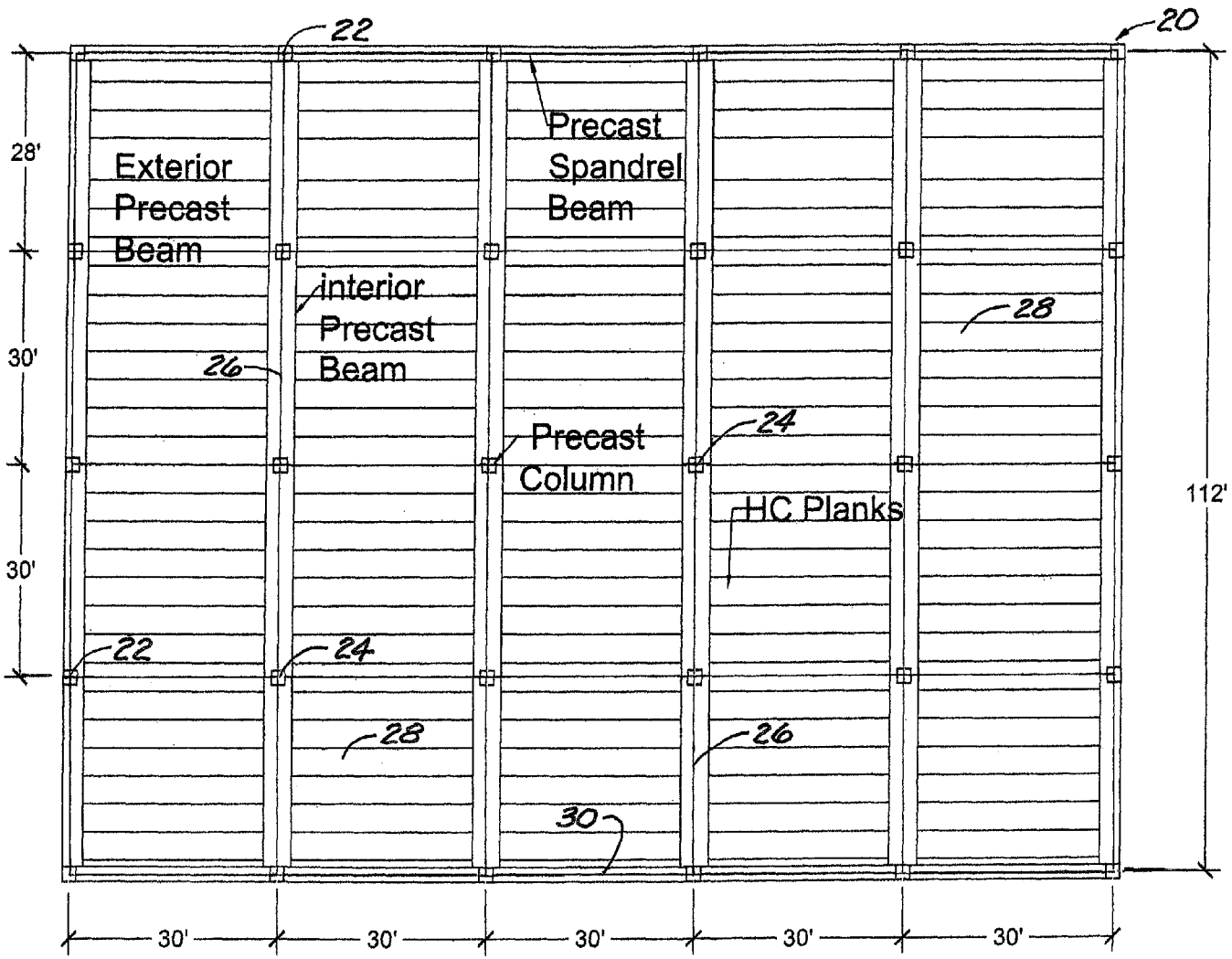
FIG. 1 is a schematic layout of an example building used to describe how the components of the present invention are erected to form a proposed floor system.

Referring to the figures, there is depicted in FIG. 1, generally at 20, a layout of a floor of a sample or exemplary building constructed using the components and systems of the present invention. The layout 20 includes twenty 30 foot bays in a 4×5 bay arrangement. Also included are eighteen precast exterior columns 22 and twelve precast interior columns 24. Beams 26 are supported on the columns and floor support member hollow-core planks 28 are supported on the beams 26. Spandrel beams 30 are supported on and between adjacent precast exterior columns 22.

Figure 2:
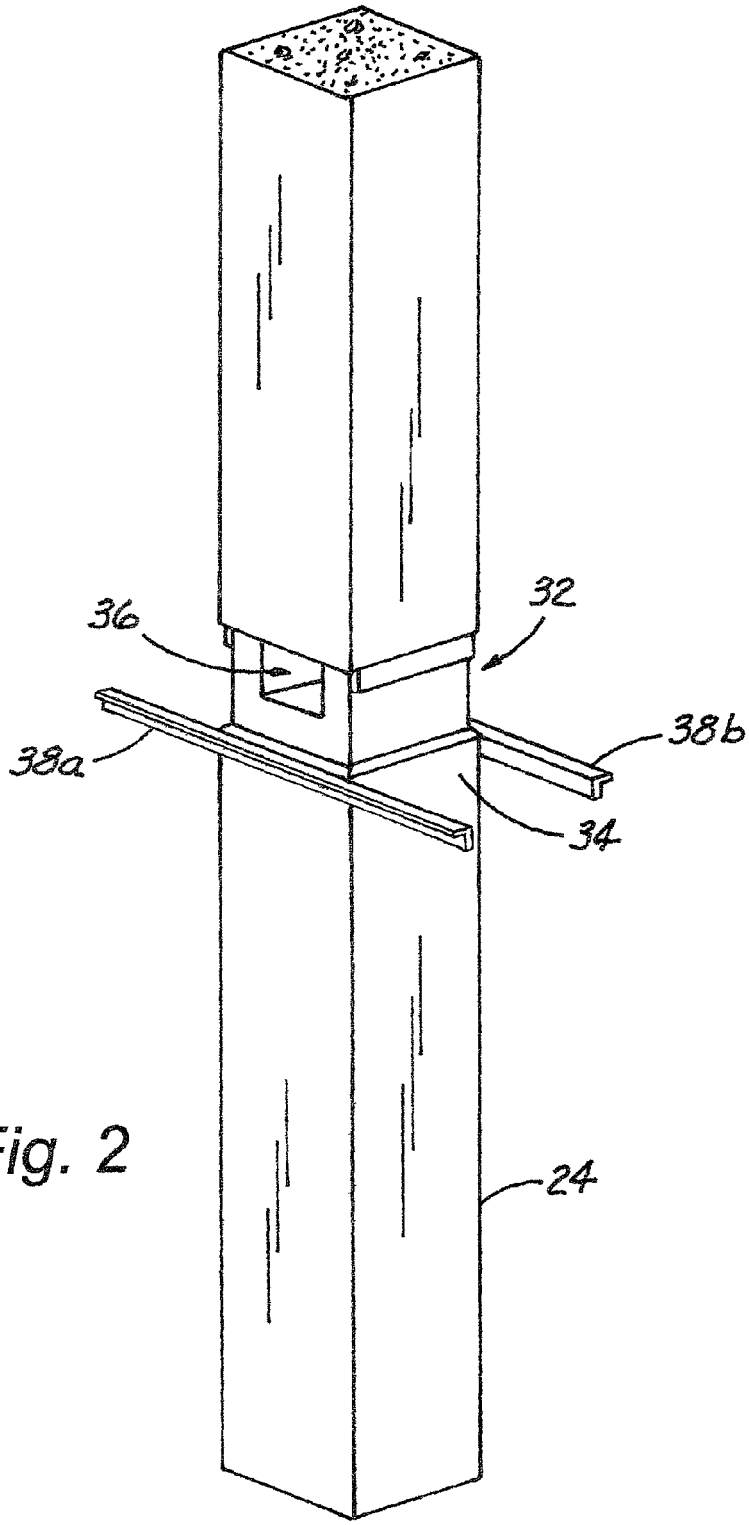
FIG. 2 is a schematic three dimensional representation of a multi-story continuous pre-cast column of the present system having an opening therethrough and with temporary corbels attached.

The precast interior columns 24 have a reduced width section, generally at 32 (FIG. 2) which forms a ledge 34 around the column 24 at the height where the floor is to be installed. In addition, an opening 36 is formed in the column 24 in the reduced width section 32. Temporary corbels 38*a* and 38*b* have been attached to the column 24 on the ledge 34 on either side of the opening 36. The temporary corbels 38 will most typically be steel angles with stiffeners that are anchored to the column 24 using high strength threaded rods (FIG. 12) through holes formed or drilled in the column 24.

Figure 3:
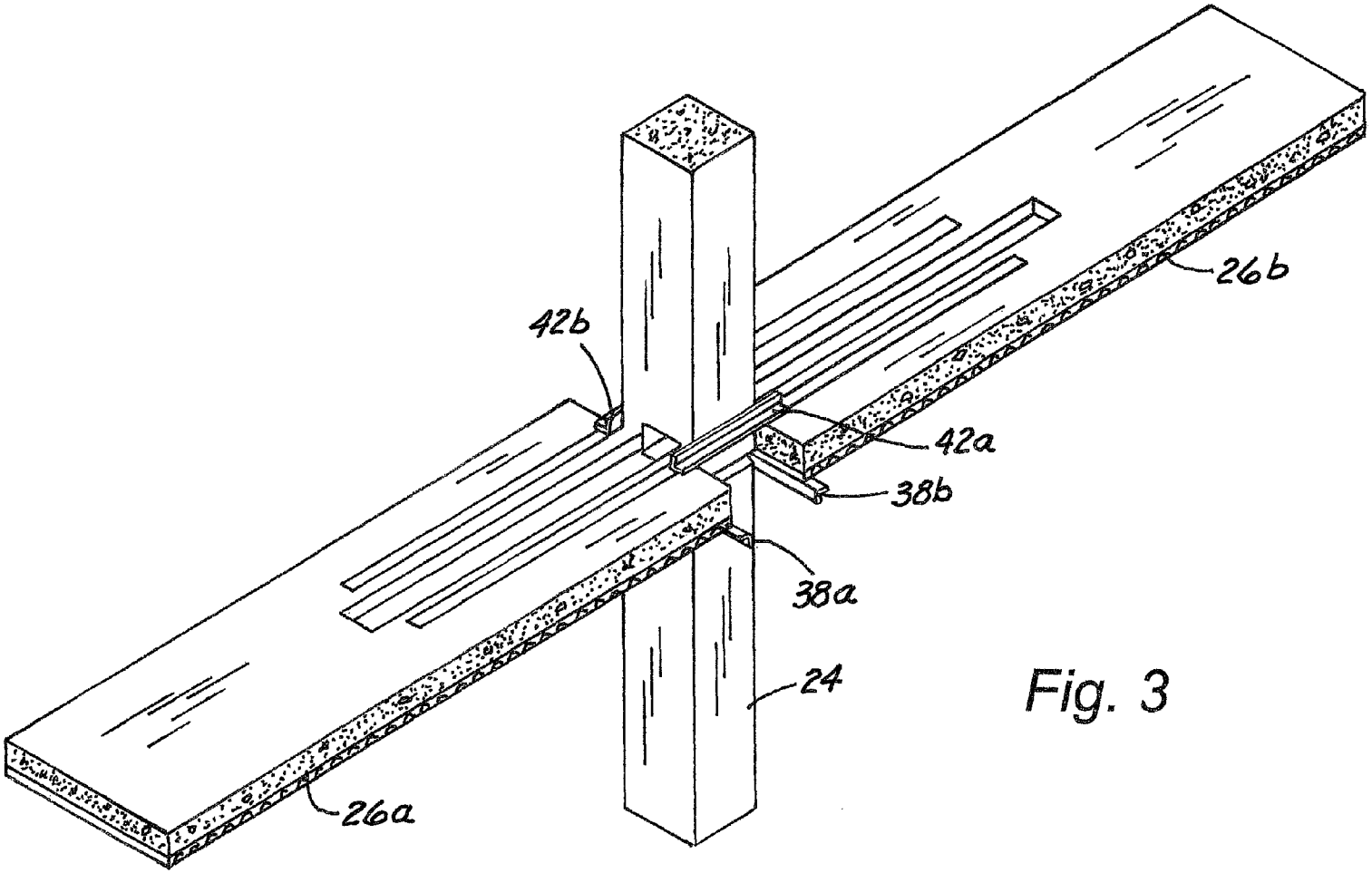
FIG. 3 is a schematic three dimensional representation of a pair of precast rectangular beams placed on the temporary corbels of the column of FIG. 2.
Figure 4:
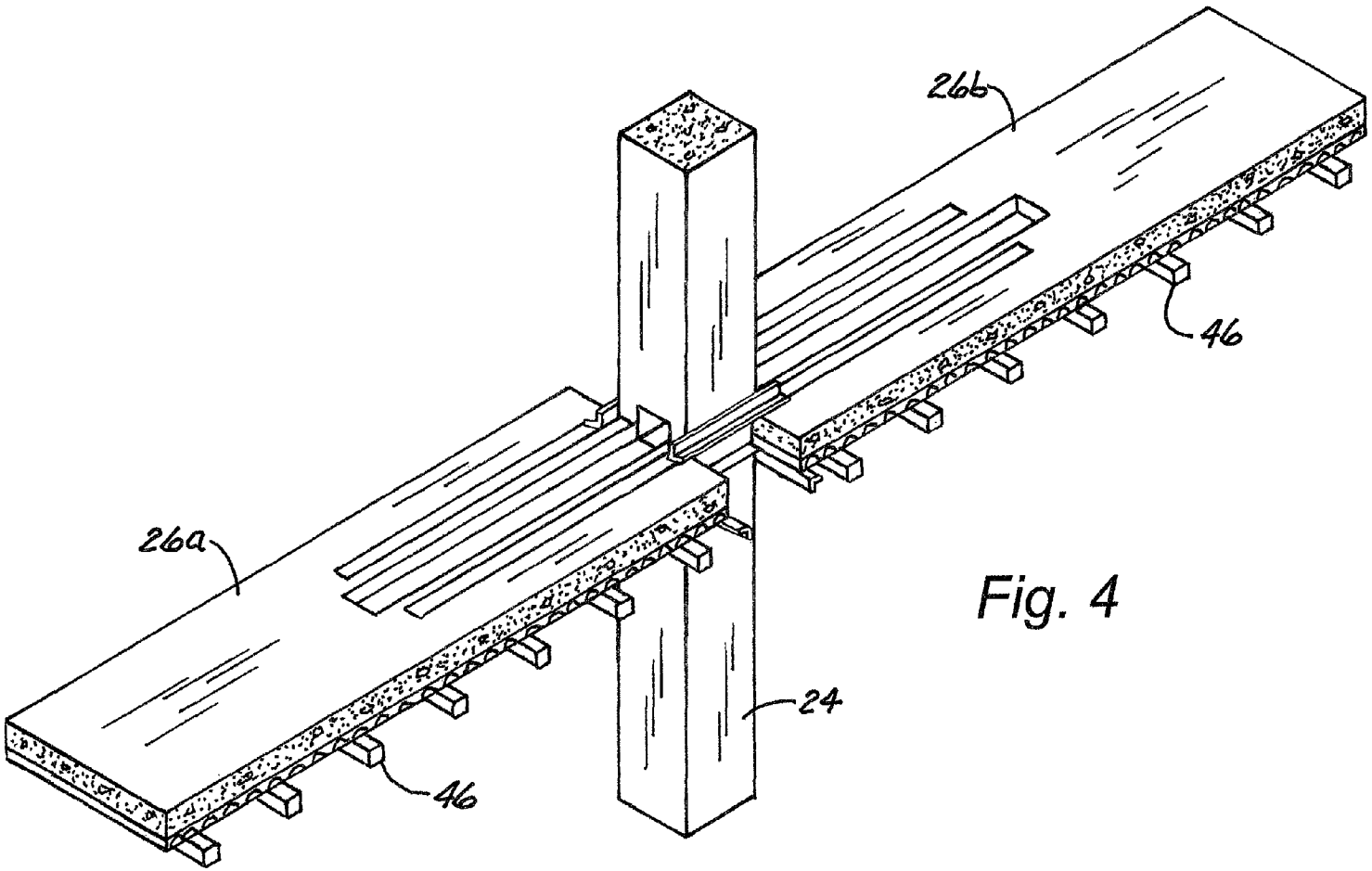
FIG. 4 is a schematic three dimensional representation of the column and rectangular beams of FIG. 3 wherein steel angles are welded to the top of the beams and to plates on the column to stabilize the beams during erection and the placement of temporary beam ledges for supporting hollow-core planks.

Precast rectangular beams 26*a* and 26*b* are placed on the temporary corbels 38*a* and 38*b* (FIG. 3). The beams 26 have steel plates 40*a* and 40*b* (FIG. 12) anchored to the top of the beams 26 preferably using high strength threaded rods. Securement members 42*a* and 42*b* are welded to the steel plates 40*a* and 40*b*, respectively, on top of the beams and to steel plates 44*a* and 44*b* (FIG. 12), respectively, anchored on the sides of the column 24 to stabilize the beams during erection. The securement members 42 will most typically be steel angles, optionally with stiffeners.

Figure 5:
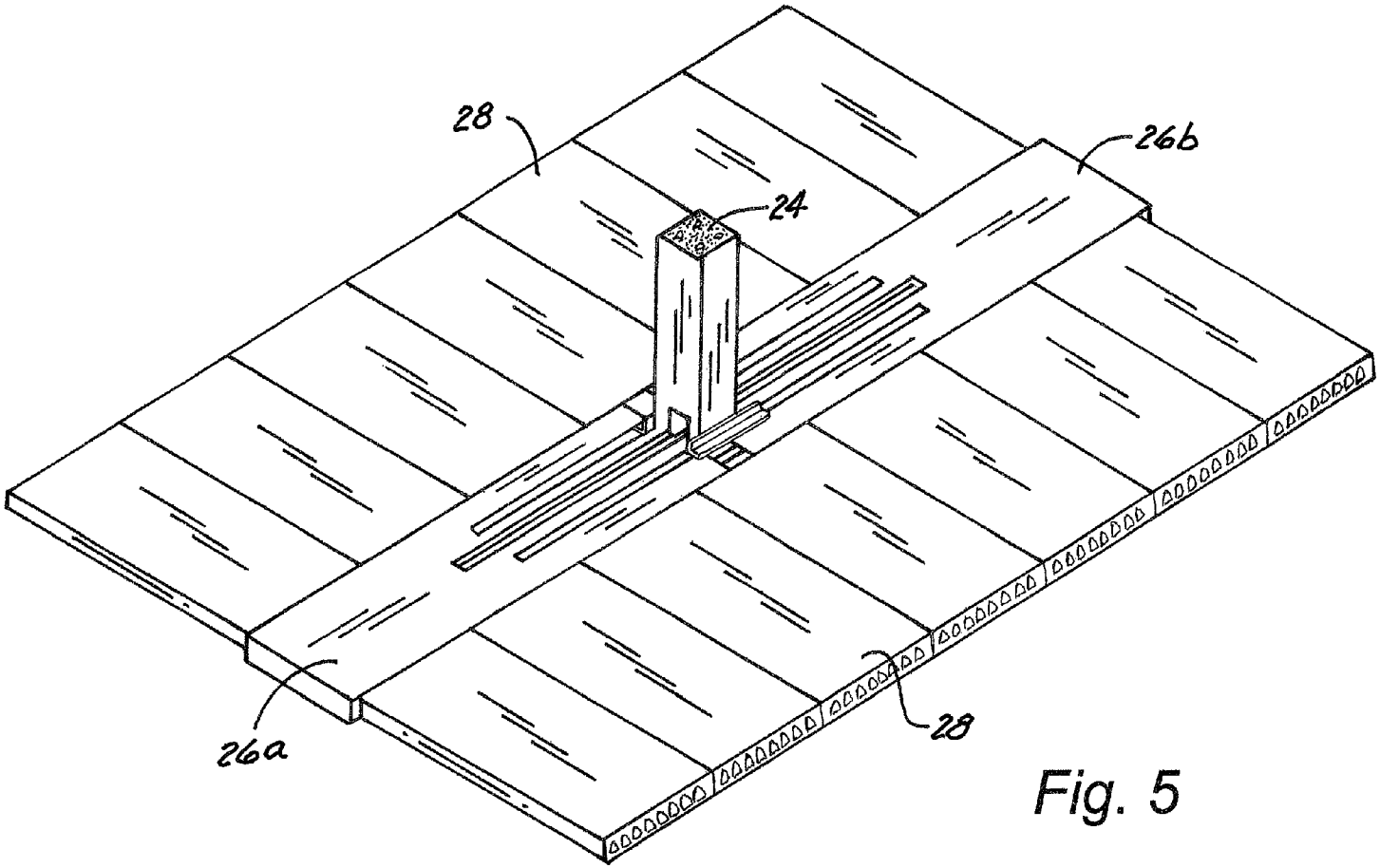
FIG. 5 is a schematic three dimensional representation of the components of FIG. 4 and wherein hollow-core planks have been placed on the temporary beam ledges for the entire floor.

Temporary beam ledges 46 are installed on the bottom side of the beams 26. The ledges 46 are preferably steel tubes or angles anchored to the beam 26 soffit using bolts and pre-installed inserts (not shown). The hollow-core planks 28 are placed on the temporary ledges 46 for the entire floor (FIG. 5).

Figure 6:
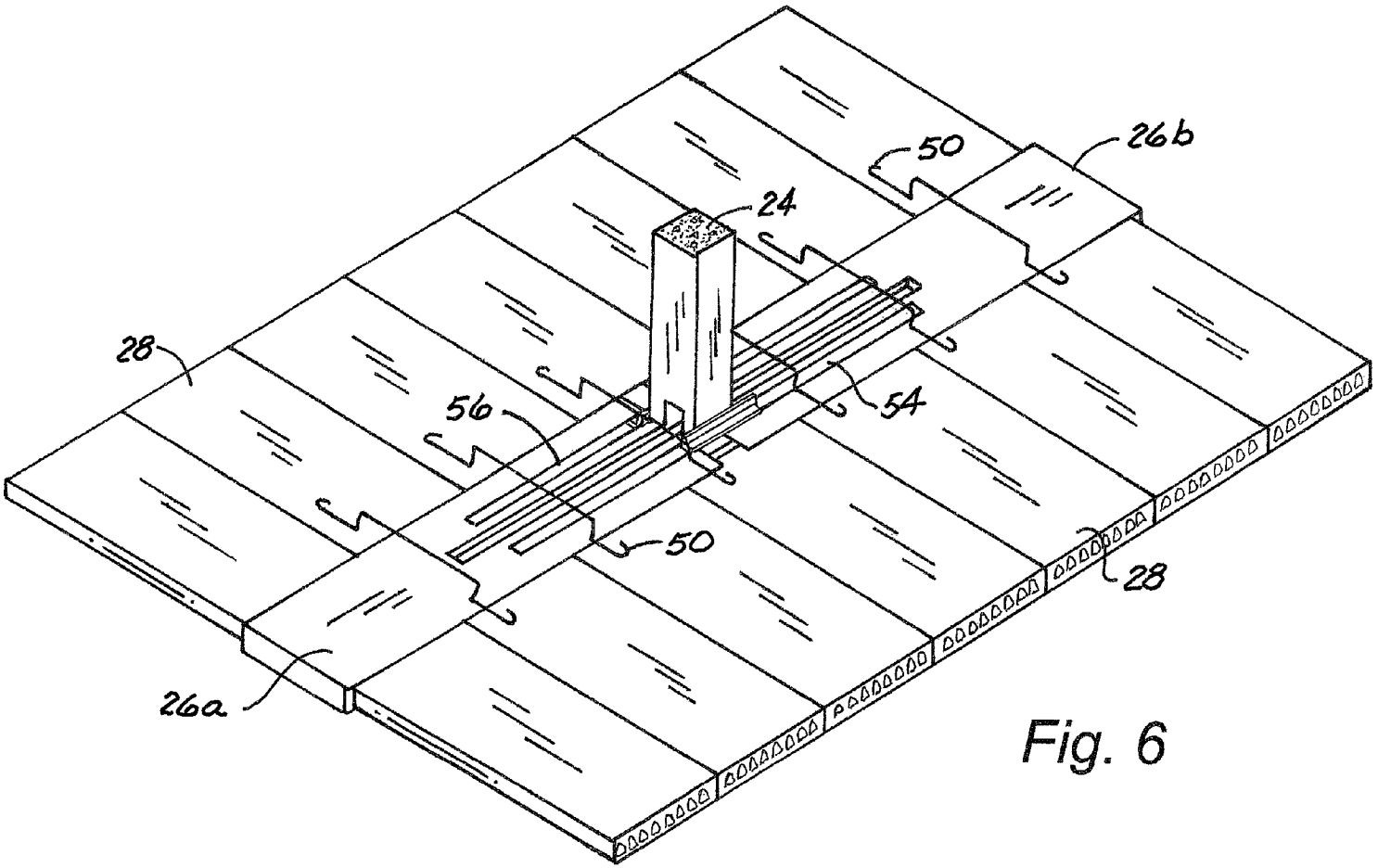
FIG. 6 is a schematic three dimensional representation of the components of FIG. 5 and wherein reinforcing hat bars have been placed in hollow-core keyways and wherein beam continuity reinforcing bars have been placed in recesses in the beams and through the opening in the column.
Figure 7:
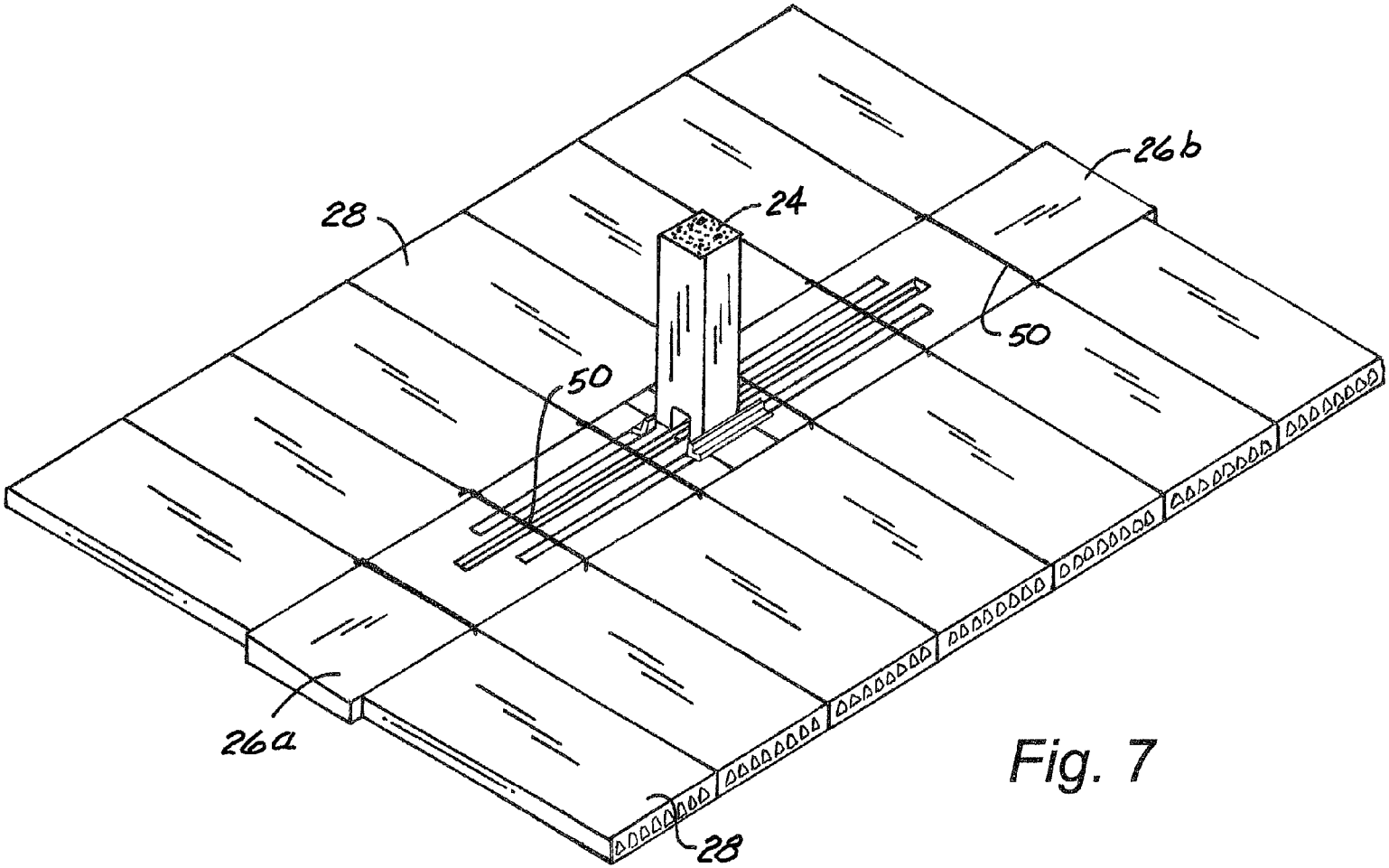
FIG. 7 is a schematic three dimensional representation of the components of FIG. 6 and wherein grout or flowable concrete is used to fill hollow-core keyways, beam recesses, shear keys between hollow-core planks and beam sides, and gaps between beam ends and column sides.
Figure 15:
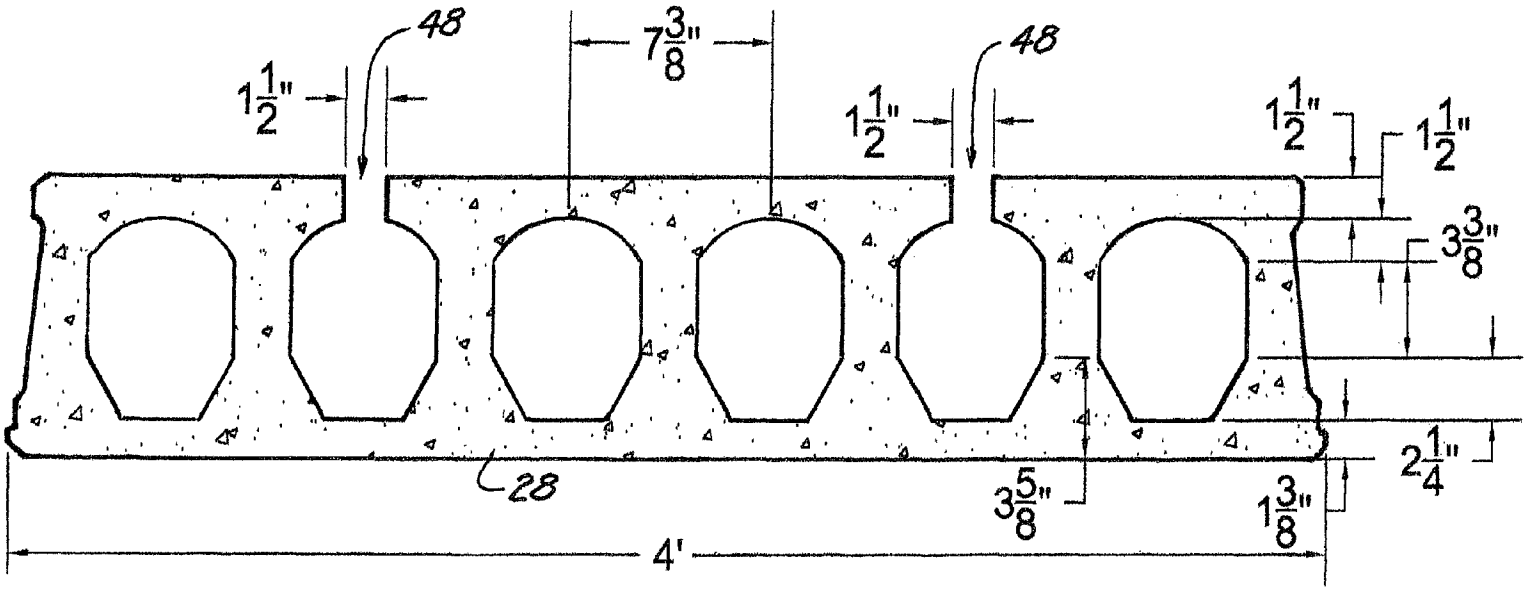
FIG. 15 is a cross-sectional view of an exemplary hollow-core plank used in the present invention and having two slots in the top surface for the placement of connection reinforcement.
Figure 17:
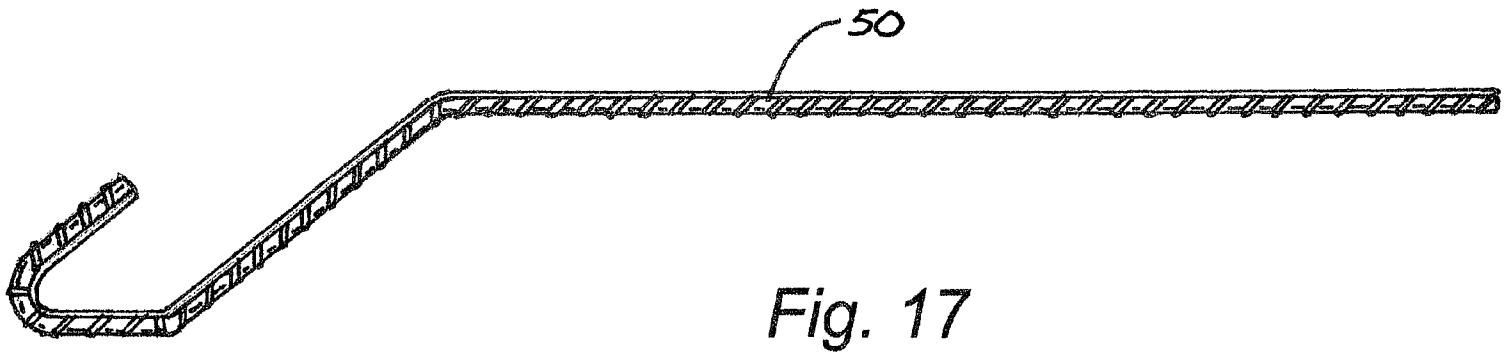
FIG. 17 is a side view of a hat bar.
Figure 18:
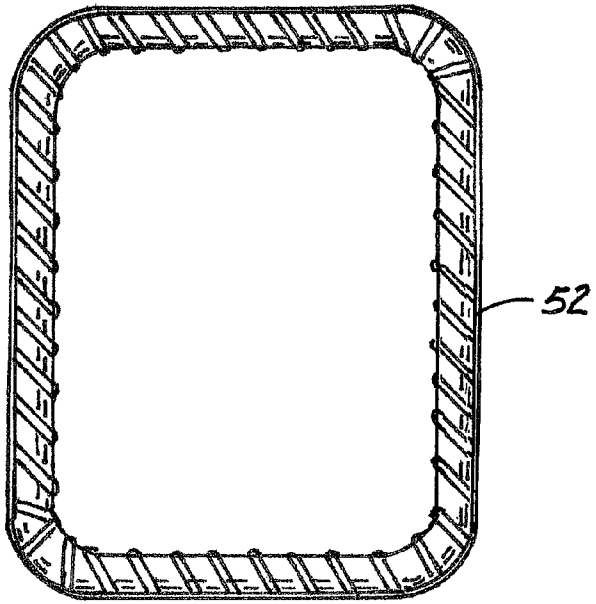
FIG. 18 is a side view of a loop bar.

In a preferred embodiment of the hollow-core planks 28, keyways 48 in the top surface are formed (FIG. 15). When the hollow-core planks 28 are in position on top of the temporary ledges 46, specially shaped steel reinforcing bars herein referred to as hat bars 50 (FIGS. 6 and 17) are placed in hollow-core keyways 48 (FIG. 7). Additionally, beam continuity reinforcing bars 52 (FIGS. 12 and 18) are placed in recesses 54 and 56 (FIG. 6) formed in the beams 26 and in the column opening 36.

Figure 8:
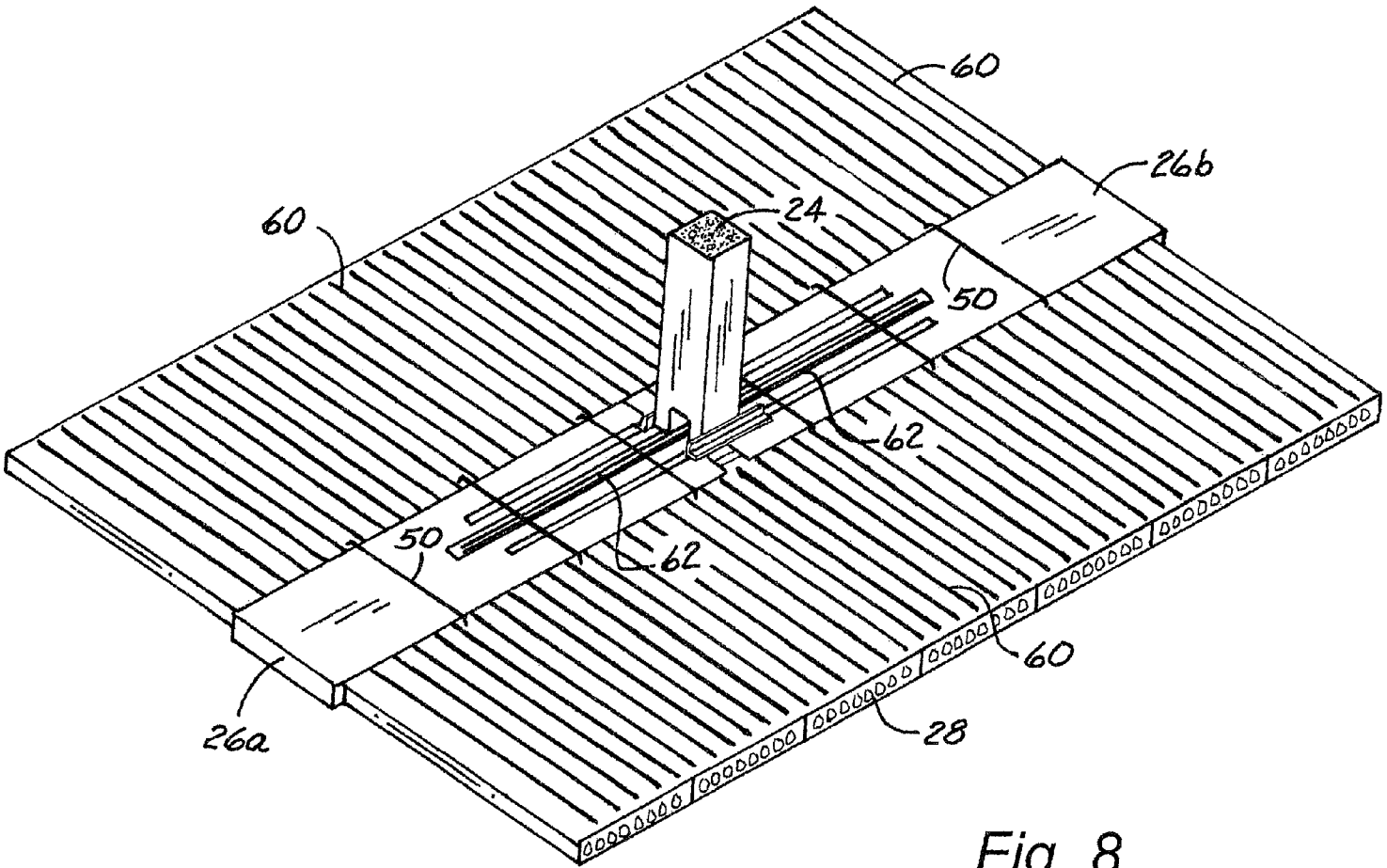
FIG. 8 is a schematic three dimensional representation of the components of FIG. 7 and wherein an additional layer of beam continuity reinforcement has been placed on top of the beams through the column opening and on each side of the column and topping reinforcement has been installed.
Figure 9:
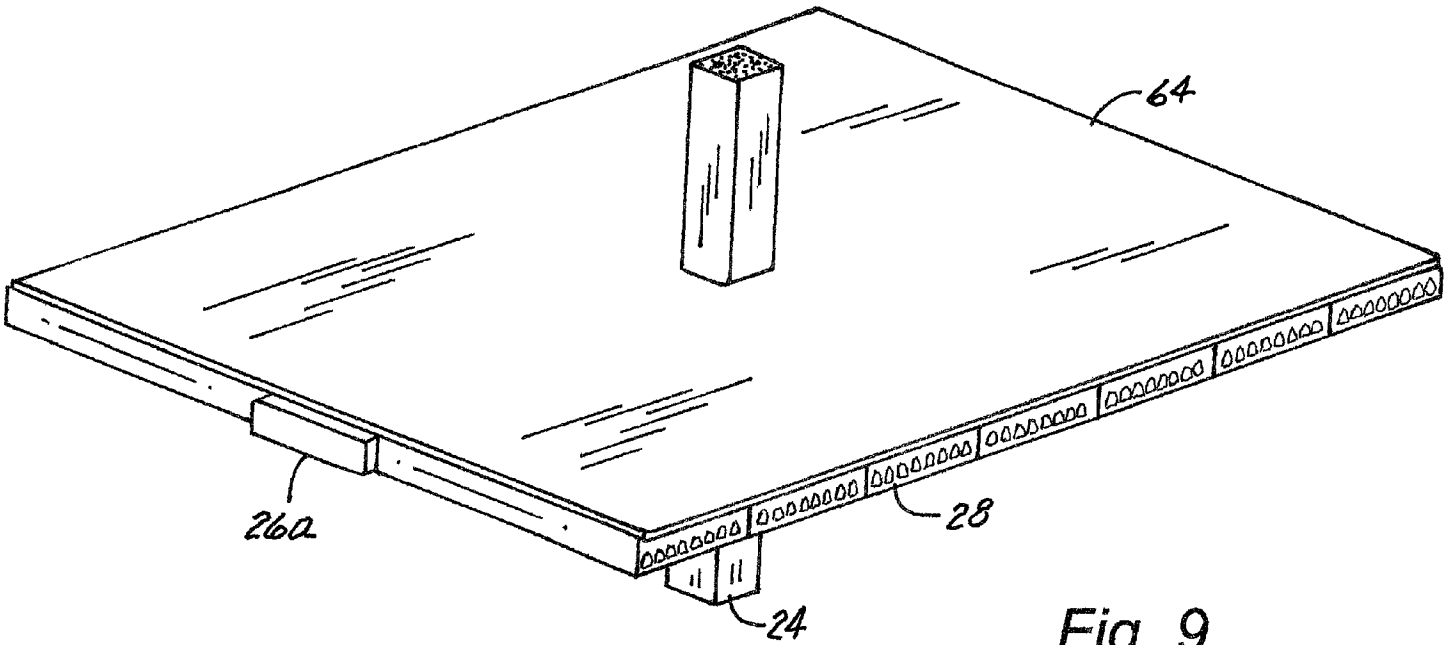
FIG. 9 is a schematic three dimensional representation of the components of FIG. 8 and wherein cast-in-place topping concrete has been provided to level the floor surface.
Figure 10:
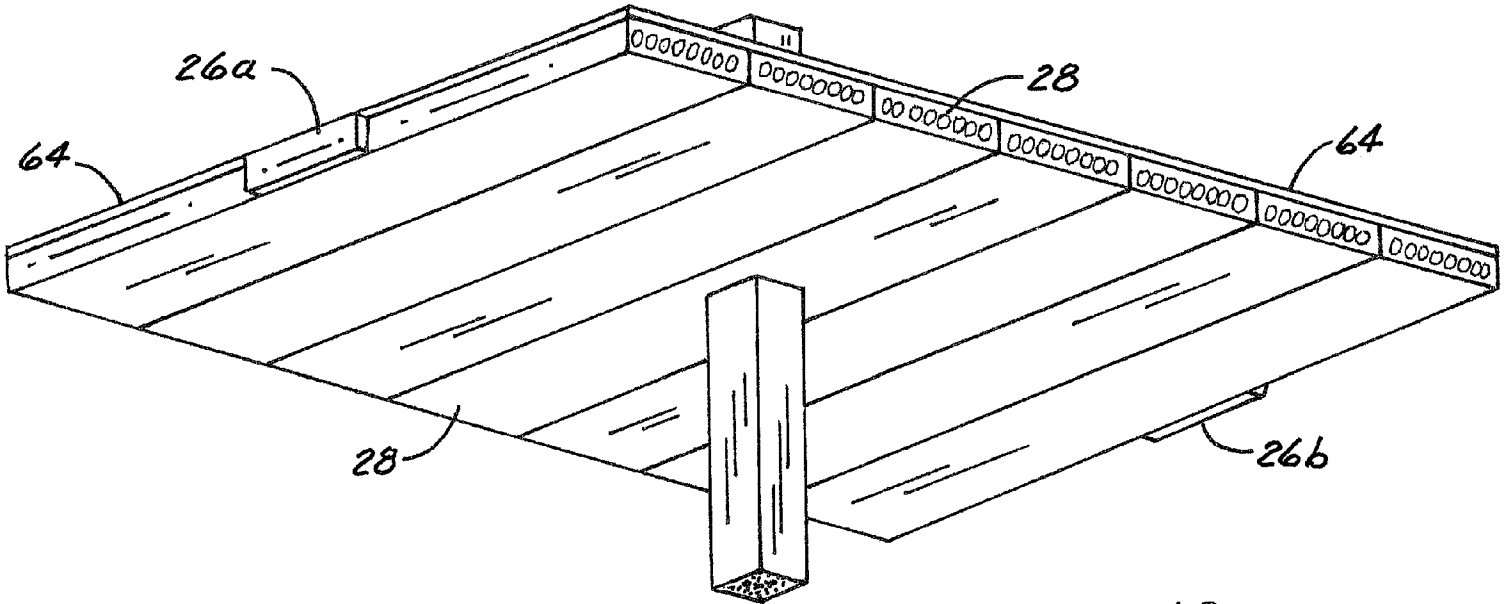
FIG. 10 is a schematic three dimensional representation from the underside of the floor system showing removal of the temporary corbels and ledges after the topping concrete reaches to required strength to provide a flat soffit.

Grout or flowable concrete is used to fill the hollow-core keyways 48, beam recesses 54 and 56, shear keys 58 between the hollow-core planks 28 and beam 26 sides, and gaps between the beam 26 ends and column 24 sides (FIG. 7). Additional layers of beam continuity reinforcement 62 are placed on top of the beams 26 through the column opening 36 and on each side of the column 24, and topping reinforcement 60 is applied to the upper surface of the floor structure (FIG. 8). A cast-in-place topping concrete 64 is placed on top of the floor structure to form a leveled floor surface (FIG. 9). Optionally, insulation is placed on top of the beams 26 and planks 28 prior to casting of the topping to provide an insulated floor system. The temporary corbels 38 and ledges 46 are removed after the topping concrete reaches the required strength to provide a flat soffit (FIG. 10).

Three key concepts were used to achieve the shallowness, flat soffit, and structural capacity of the proposed floor system under gravity loads. First, the width of the beams 26 was increased to accommodate a larger number of prestressing strands while minimizing its depth. Also, larger diameter strands than are commonly used in inverted tee beams were used to allow for higher prestressing force and eccentricity despite the shallow depth. In a constructed embodiment, 0.6 inch diameter strands were used instead of 0.5 inch diameter used in the art. Second, increasing beam 26 continuity for topping weight and live loads improves the beam resistance to gravity loads and eliminates the need for permanent corbels on the column 24. This continuity necessitates having an opening 36 in the precast column 24 at the beam 26 level to allow the reinforcement in the beam recesses 54 and 56 to go through the column 24 in addition to the reinforcement in the cast-in-place topping 64. Beam continuity reinforcement will also provide adequate support for the beam 26 as it creates a hidden corbel. Third, eliminating beam ledges by using temporary ledges 46 during construction. The hollow-core plank 28 to beam 26 connection is made using shear keys 58 or hidden corbels and reinforcing bars to transfer the vertical shear from the hollow-core planks 28 to beam 26 under ultimate loads after the removal of the temporary ledges 46.

Figure 11:
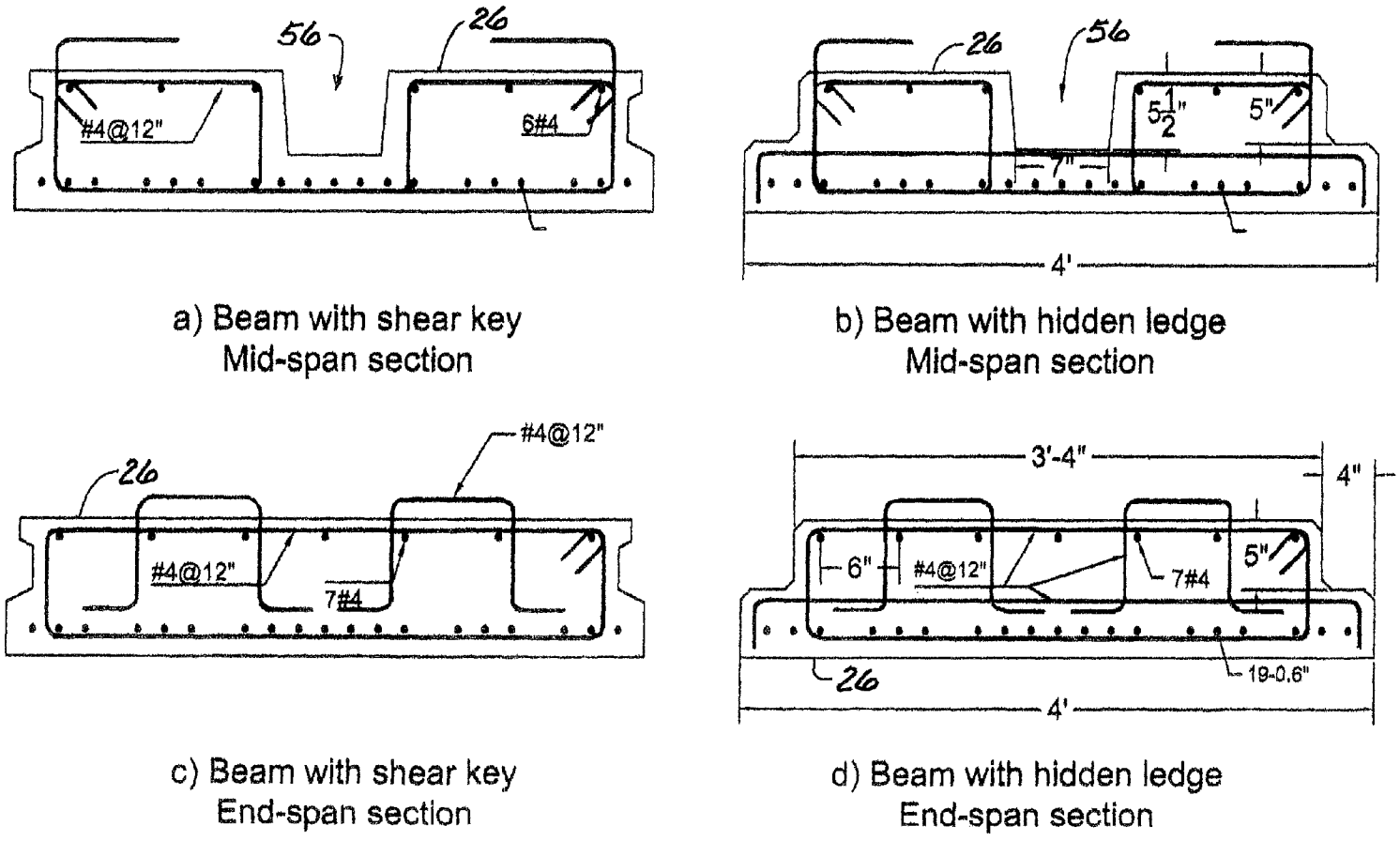
Figure 12:
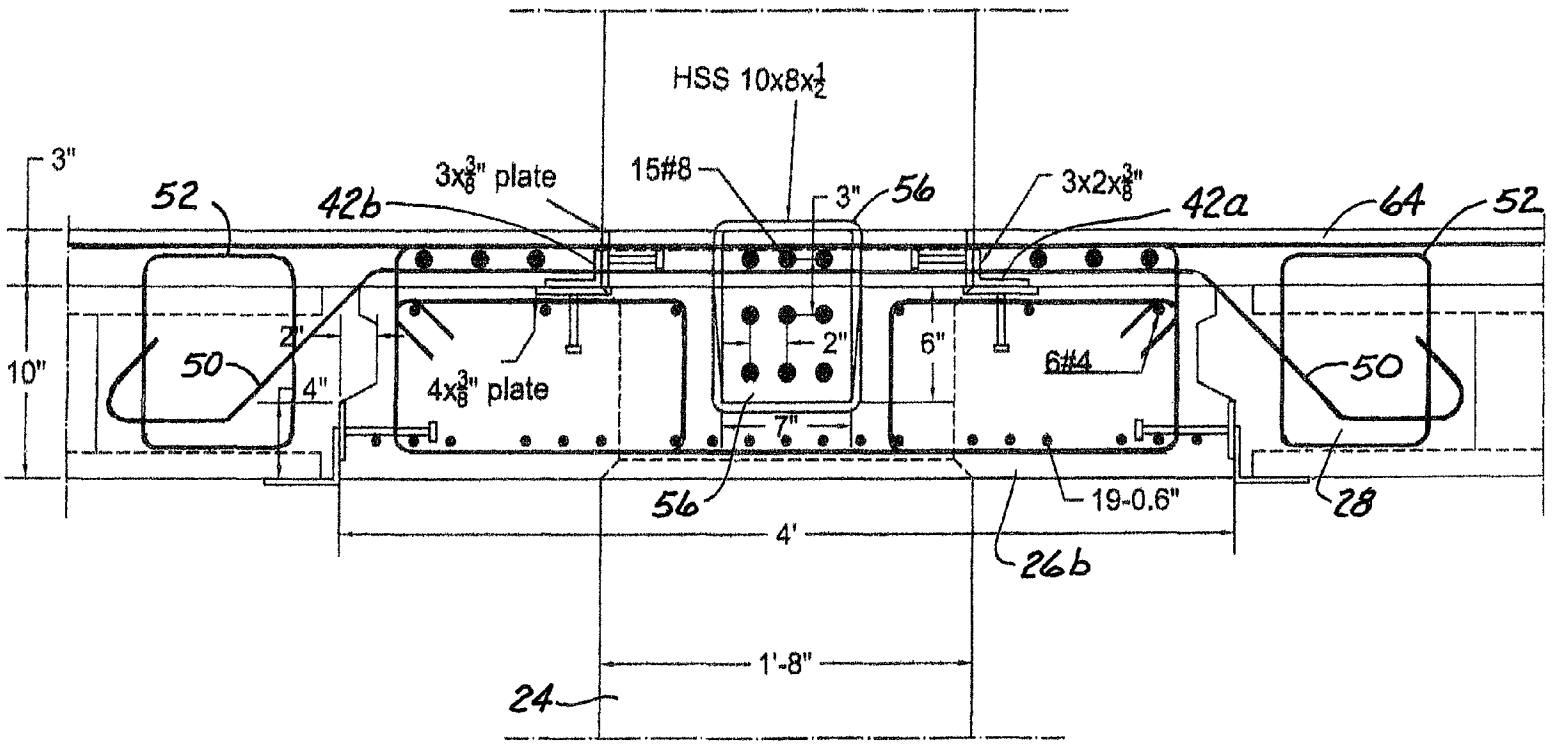
FIG. 12 is a lateral cross-sectional view through the beams supported on the column.

FIG. 11 shows the cross sections of the precast prestressed rectangular beam 26 designed for the example building floor shown in FIG. 1. Cross sections "a" and "c" present, respectively, the middle and end sections of the beam 26 with shear key, while cross sections "b" and "d" present, respectively, the middle and end sections of the beam with hidden ledge. FIG. 12 shows the reinforcement details of the beam 26 to column 24 connection (i.e., the hidden corbel) and hollow-core plank 28 to beam 26 connection (i.e., the shear key 58) for the example building floor. It should be noted that the design of these connections is conducted using the shear-friction design method of ACI 318-11 Section 11.6.4 (ACI, 2011). Grade 60 reinforcing bars and cast-in-place concrete are used to create shear-transfer mechanism between precast beam 26 and column 24 components, and between precast hollow-core planks 28 and beam 26 components. A coefficient of friction equal to 1 is used between cast-in-place concrete placed against hardened precast concrete assuming that the contact surface is intentionally roughened. The hollow-core-beam connection is assumed to be hinged connection, while the beam-column connection is assumed to be a moment resisting connection as the continuity reinforcement extends beyond the negative moment region. Flexural capacities of both mid-span and end-span sections are calculated using strain compatibility approach for the following loading conditions: (a) Simply supported non-composite beam for prestressing force and beam and hollow-core self-weight; (b) continuous non-composite beam for topping weight; and (c) continuous composite beam for live load and superimposed dead load.

EXAMPLE 2

Figure 13:
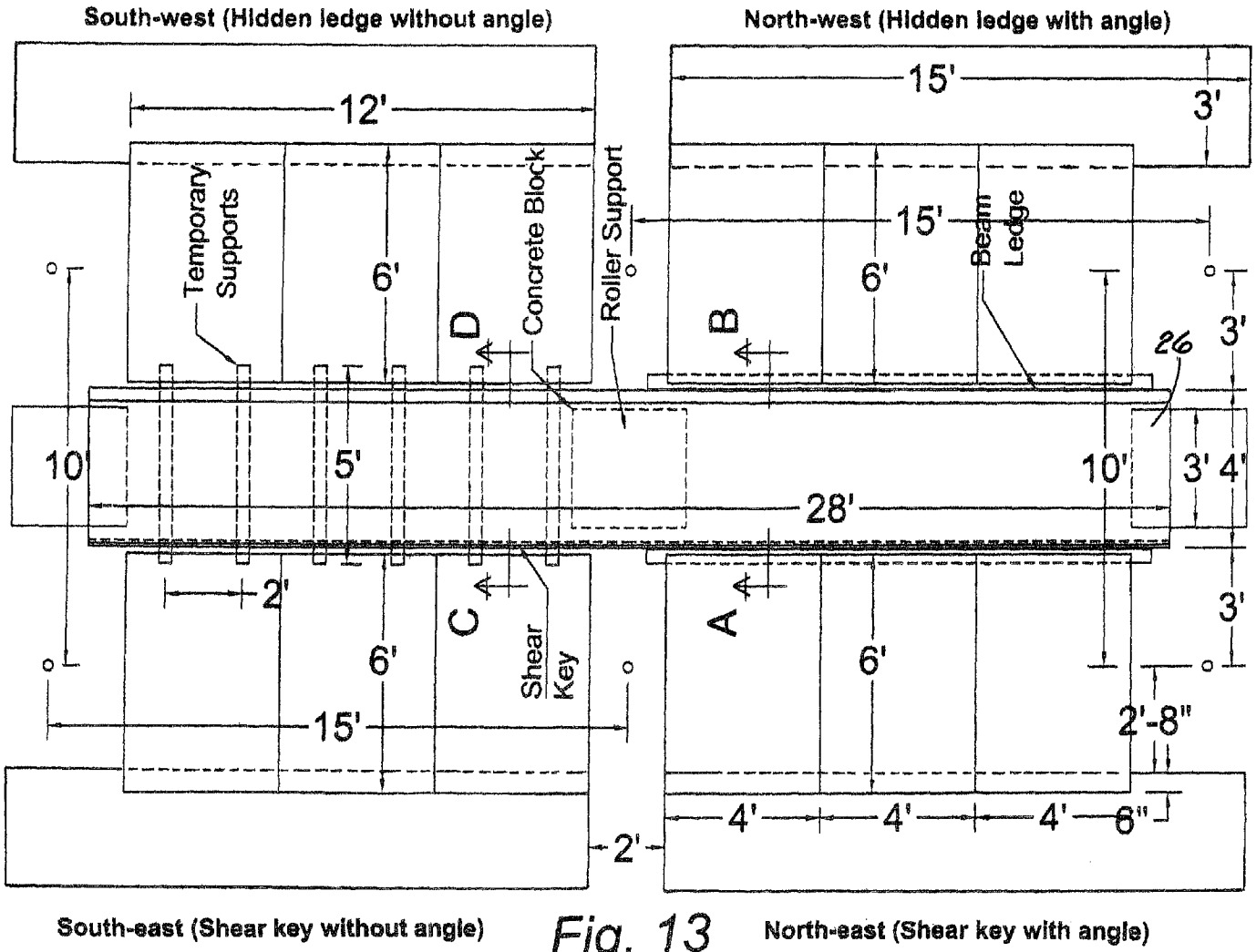
FIG. 13 is a schematic plan view of four alternative floor systems of the present invention, namely wherein the beam depicted in the upper left corner has a hidden ledge without an angle, the beam depicted in the upper right corner has a hidden ledge with an angle, the beam depicted in the lower right corner has a shear key with an angle, and the beam depicted in the lower left corner has a shear key without an angle.
Figure 14:
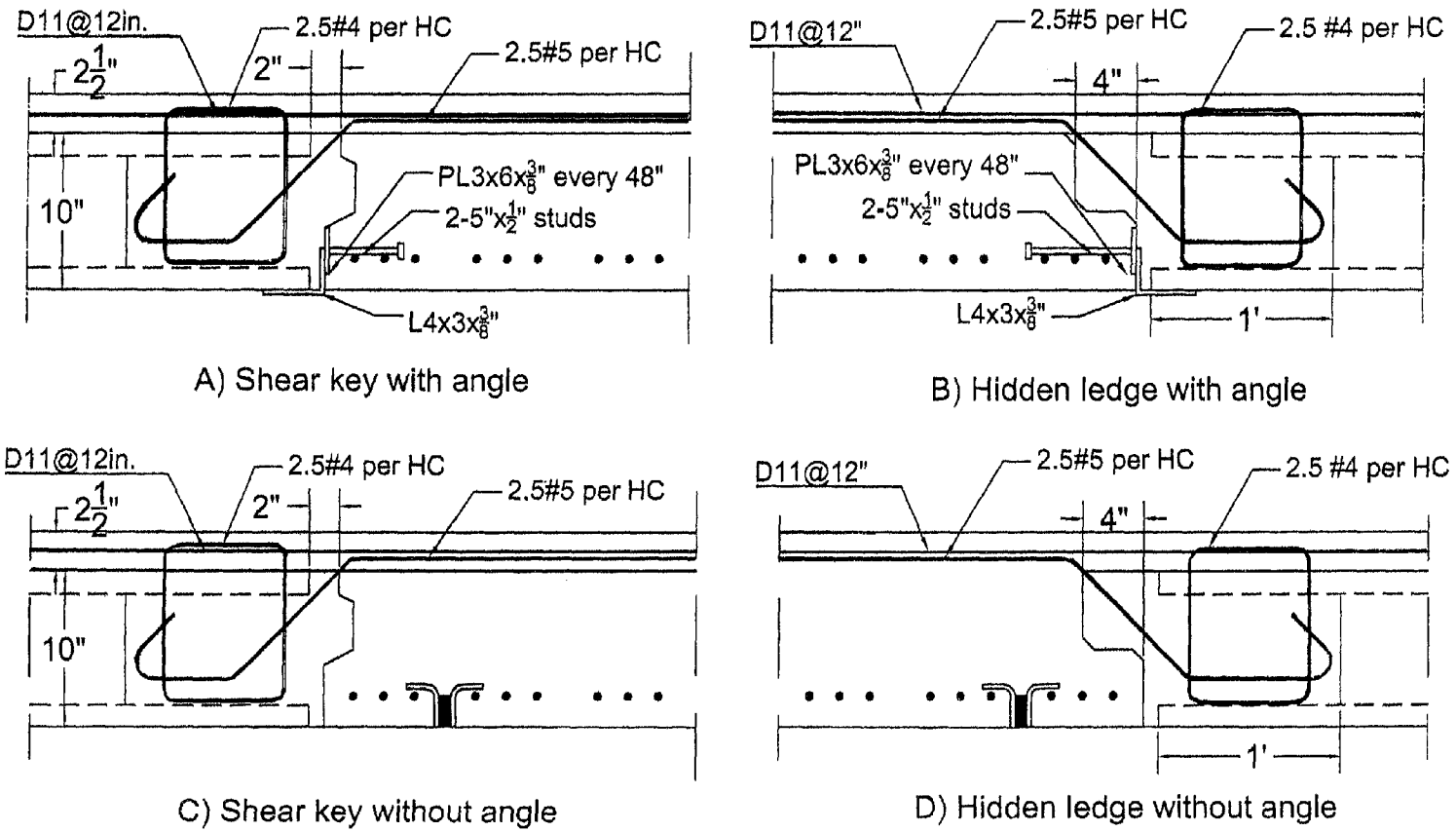
FIGS. 14A-D are cross-sectional views taken along the respective lines of FIG. 13.

The experimental investigation presented was carried out to evaluate the shear capacity of four different hollow-core-beam connections as well as the flexural capacity of the shallow rectangular beam. The shear capacity of beam-column connection (i.e., hidden corbel) was evaluated in an earlier investigation (Morcous and Tadros, 2011). The full-scale test specimen shown in FIG. 13 consists of a 28 ft long, 10 inch thick, and 48 inch wide precast rectangular beam 26 and twelve 6 ft long, 10 inch thick, and 48 inch wide hollow-core plank 28 segments. In the shown test setup, the beam 26 was supported by three roller supports (i.e. two end supports and one middle support) to minimize beam deflection while testing the capacity of hollow-core-beam connections. The beam 26 was fabricated with two different alternatives of ledge-less hollow-core connections, shear key and hidden ledge. For each alternative, two temporary ledges were used to support hollow-core planks during construction: 1) steel tubes (HSS 4×4×¼) were attached to the beam soffit using ¾ inch threaded rods and coil inserts embedded in the precast beam and removed after the topping was hardened; and 2) steel angles (L 4×3×⅜) were welded to pre-installed beam side plates and remained in the specimen during testing. FIG. 13 shows the four different combinations of beam-hollow-core connections tested: Hidden ledge with angle, shear key with angle, hidden ledge without angle, and shear key without angle. FIG. 14 shows the dimensions and reinforcing details of each of the four connections. Hollow-core planks 28 used in this specimen have two 1 ft long, and 1.5 inch wide keyways 48 in the top surface as shown in FIG. 15 to allow placing connection reinforcement, for example, the hat bars 50.

Figure 16:
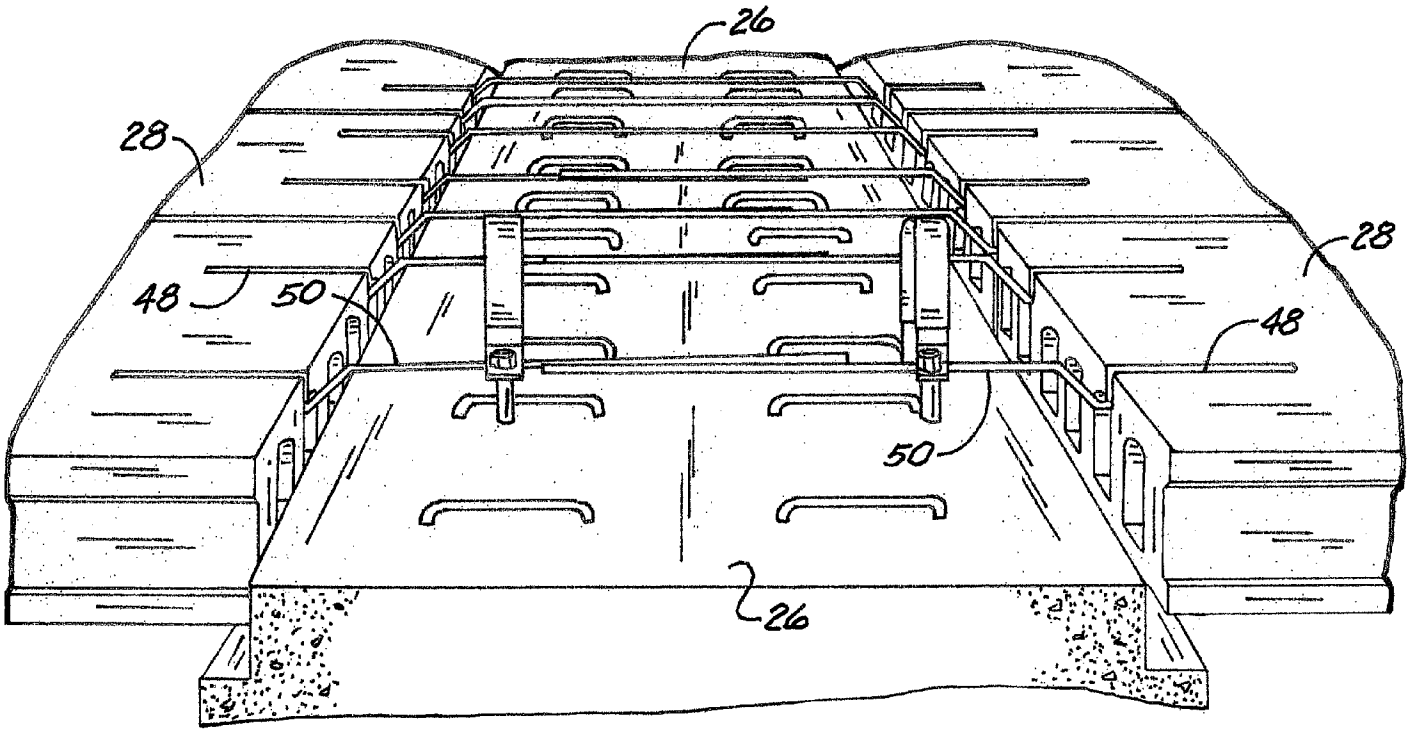
FIG. 16 is a perspective view of a beam and associated hollow-core planks showing placement of hat bars and loop bars for reinforcement.

FIG. 16 shows the specimen before placing the 2-inch thick cast-in-place concrete topping. The reinforcement of hollow-core-beam connections consists of the hat bars 50 and loop bars 52 as shown in FIG. 16. The hat bars 50 (FIG. 17) were placed over the beam 26 in the hollow-core slots and keyways 48 to resist the vertical shear between the beam 26 and hollow-core planks 28. The loop bars 52 (FIG. 18) were placed in the hollow-core slots to resist the horizontal shear between the hollow-core planks 28 and the topping 64. Twenty four strain gauges were attached to the reinforcement (six strain gauges in each connection), which are classified as follows: three gauges to the hat bars 50 and three gauges to the loop bars 52. After grouting the hollow-core keyways, slots, and shear keys, topping reinforcement is installed. Eight strain gages were attached to the topping reinforcement (two in each connection). Finally concrete topping was poured and temporary ledges were removed after reached the specified strength. Table 1 summarizes the specified and attained concrete strength at the time of testing for precast, grout and topping concrete.

TABLE 1

Specified and actual concrete compressive strength at time of testing

| Components | Specified Strength (psi) | Actual Strength (psi) |
|---|---|---|
| Precast | 8,000 | 9,390 |
| Grout | 4,000 | 8,037 |
| Topping | 3,500 | 5,678 |

Two tests were performed, testing the hollow-core-beam connection in the four different configurations (hidden ledge with angle, shear key with angle, hidden ledge without angle, shear key without angle, and hidden ledge without angle by loading the hollow-core as cantilever), and testing the beam flexural capacity.

A. Testing hollow-core-Beam Connection

Figure 19:
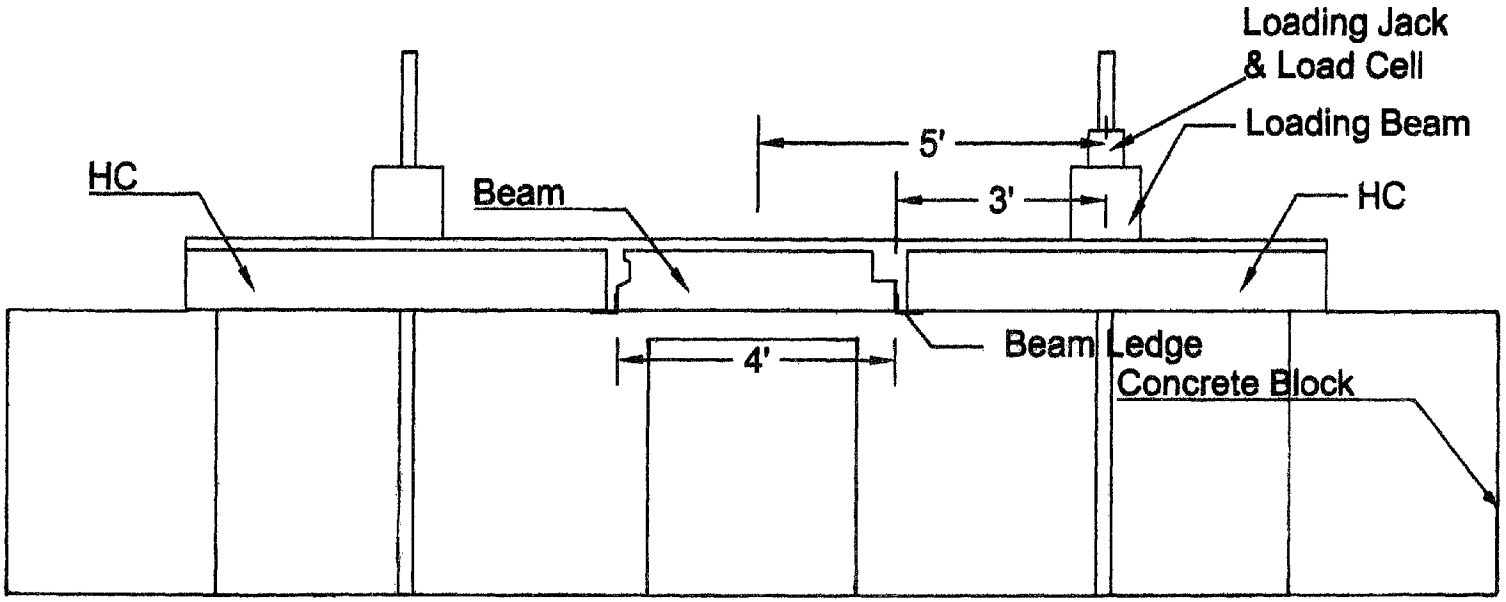
FIG. 19 is a schematic of testing apparatus used to test the floor system of the present invention.

The purpose of this test is to evaluate the shear capacity of the hollow-core-beam connections under gravity loads. The hollow-core planks were loaded at their mid-span in one side while clamping the other side of the beam to maintain specimen stability. Testing was performed using two jacks applying two concentrated loads to a spread steel beam to create uniform load on the hollow-core planks at 3 ft away from the hollow-core-beam connection. Loading continued to failure while measuring the deflection under the load using potentiometer attached to the soffit of the middle hollow-core plank. The hollow-core-beam connection was tested in two stages. In the first stage, hollow-core planks were loaded up to 100 kips (50 kips each side), which creates a shearing force at the connection of 16.5 kips. This value is the ultimate shearing force due to factored dead and live loads. In the second stage, hollow-core planks were loaded up to the failure. The factored load applied to shear the hollow-core-beam connection using shear friction theory was predicted to be 209 kip (104.5 kip each side, which is 34.9 kip per hollow-core). Also, the factored loads applied to fail the composite hollow-core planks in flexure and shear were predicted to be 315 kip (157.5 kip each side, which is 52.5 kip per hollow-core) and 240 kip (120 kip each side, which is 40 kip per hollow-core) respectively. FIG. 19 shows the test setup.

1. Hidden Ledge with Angle

Two 130 kip jacks were used to test the connection. In the first stage of loading, the specimen performed well under ultimate design load with no signs of failure or cracking. In the second stage, hollow-core planks were loaded up to 258 kip (129 kip each side). The test was stopped after reaching the ultimate load capacity of the used jacks. The applied load creates a shearing force at the hollow core-to-beam connection of 43 kips. This value is almost 2.6 times the demand and 12% more than the design capacity of the connection. At that load, the connection did not crack, while small shear cracks were observed in the other end of hollow-core.

2. Shear Key with Angle

Two 400 kips jacks were used in this test. The specimen performed well under ultimate design load with no signs of failure or cracking. In the second stage, hollow-core planks were loaded up to 240 kip (120 kip each side) without even cracking the connection. The test was stopped due to the shear failure of hollow-core planks. The applied load created 40 kip shearing force on each hollow-core. This value is almost 2.4 times the demand and 15% more than the design capacity of the connection.

3. Hidden Ledge without Angle

Two 400 kips jacks were used in this test. The specimen performed well under ultimate design load with no signs of failure or cracking. In the second stage, hollow-core planks were loaded up to 204 kips (102 kips in each side) without even cracking the connection. The test was stopped because of the shear failure of hollow-core planks. The applied load created 34 kip shearing force on each hollow-core. This value is almost 2.1 times the demand and equal to the design capacity of the connection.

4. Shear Key without Angle

Two 130 kips jacks were used in this test. The specimen performed well under ultimate design load with no signs of failure or cracking. In the second stage, hollow-core planks were loaded up to 227 kips (113.5 kips each side) without even cracking the connection. The test was stopped due to the shear failure hollow-core planks. The applied load created 37.8 kip shearing force on each hollow-core. This value is almost 2.3 times the demand and 8% more than the design capacity of the connection.

centre of the beam, while measuring the deflection at mid-span of the hollow-core. The clamped side was clamped at 5 ft from the centre of the beam.

Figure 22:
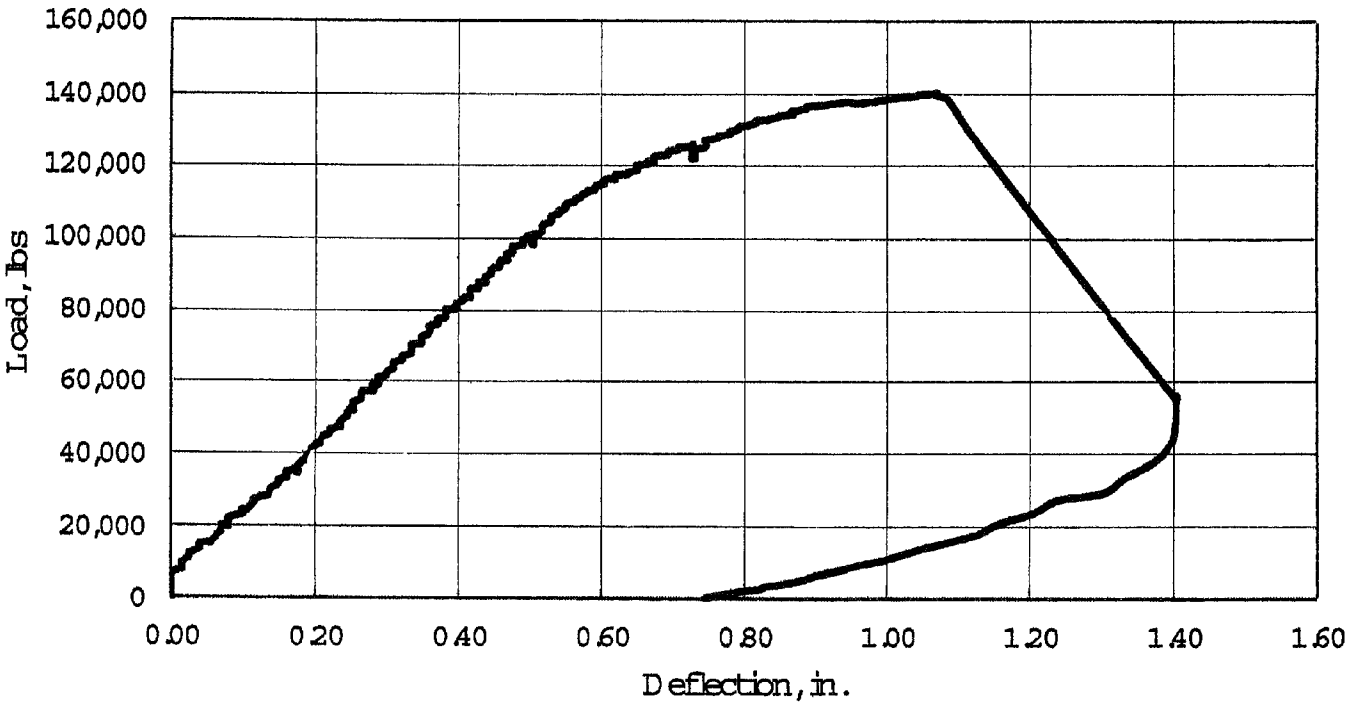
FIG. 22 is a graphical representation of the load-deflection relationship of the floor system using the apparatus of FIG. 21.
Figure 23:
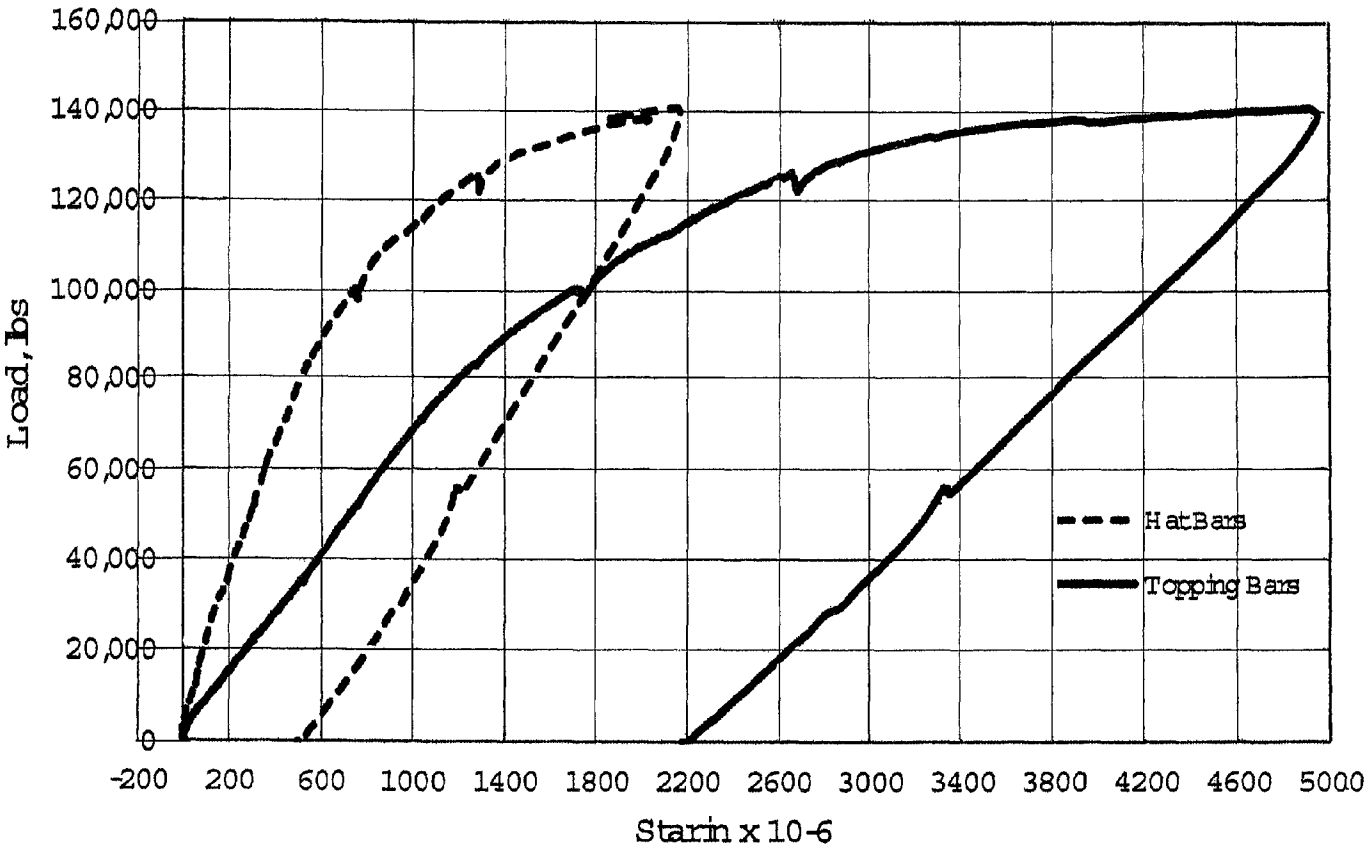
FIG. 23 is a graphical representation of the load-deflection relationships for connection reinforcement of the floor system using the apparatus of FIG. 21.

FIG. 22 plots the load-deflection relationship. This plot indicates that the three composite hollow-core planks in the south-west side were able to carry 140 kip, which corresponds to a total shear force 147.7 kip includes the self-weight of the hollow-core and topping (49.2 kip per hollow-core). This is almost three times the demand and 40% more than the design capacity of the hollow-core-beam connection. FIG. 23 plots the load-strain relationships for connection reinforcement, which indicate that the topping reinforcement and hat bars reached the yield stress. The test was stopped due to the shear failure of the hollow-core at the clamped side and severe cracking of the connection. Table 2 summarizes the previous hollow-core-beam connections test results

TABLE 2

Summary results for hollow-core (HC) to beam connections tests

| Test ID | Test Title | Applied Load (kip) | Measured Capacity (kip)/HC | Designed Capacity (kip)/HC | Demand (kip)/HC | HC Shear Capacity (kip) | Observation |
|---|---|---|---|---|---|---|---|
| A | Hidden ledge with angle (Three point loading) | 258 | 43.0 | 34.9 | 16.5 | 40.0 | Test stopped because of reaching the capacity of the loading jacks |
| B | Shear key with angle (Three point loading) | 240 | 40.0 | | | | HC shear failure |
| C | Hidden ledge without angle (Three point loading) | 204 | 34.0 | | | | HC shear failure |
| D | Shear key without angle (Three point loading) | 227 | 37.8 | | | | HC shear failure |
| E | Hidden ledge without angle (HC loaded as cantilever) | 147 | 49.2 | | | | HC shear failure and several cracks in the connection |

Figure 20:
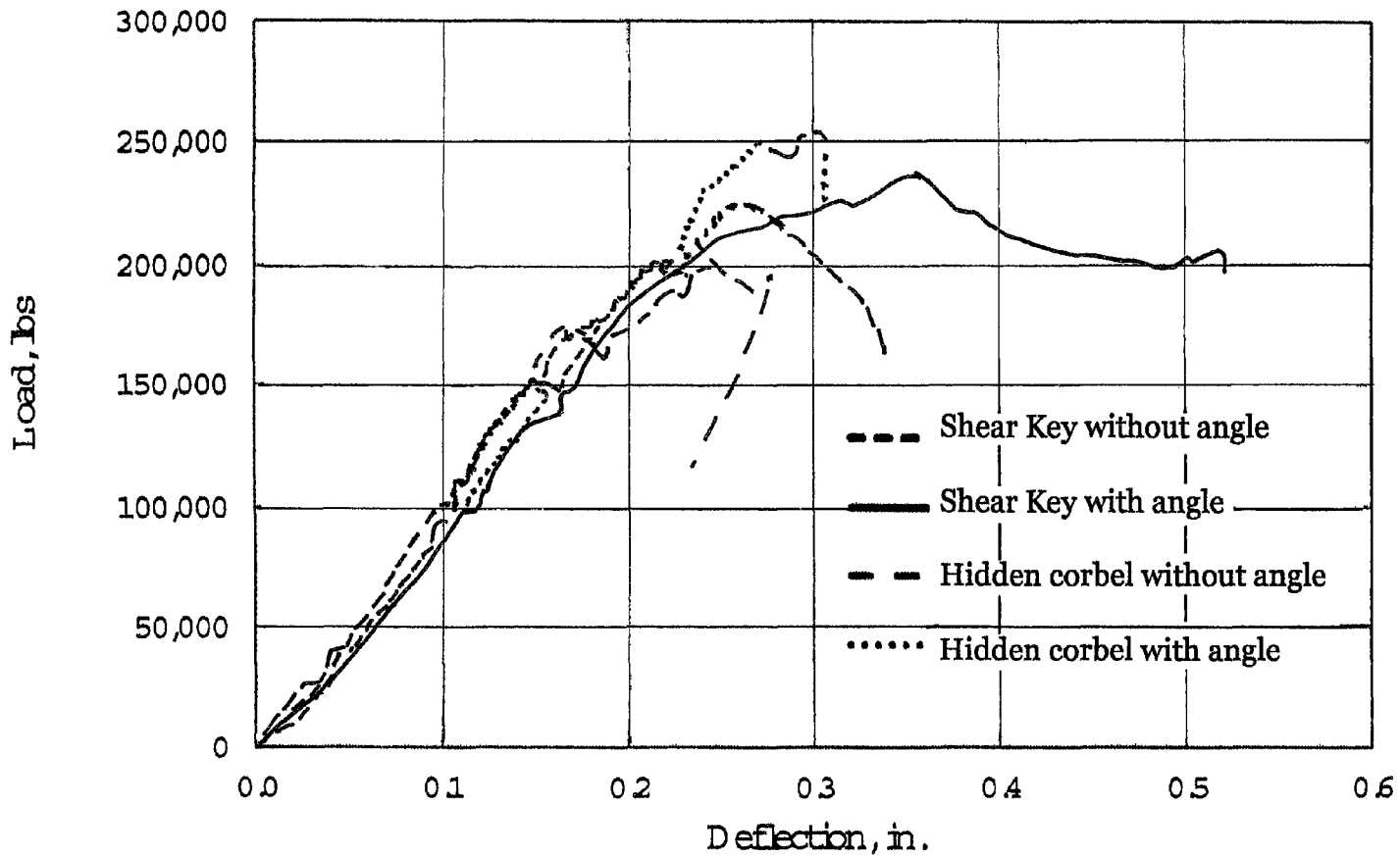
FIG. 20 is a graphical representation of the load deflection relationships of the four tested connections.

FIG. 20 presents the load deflection relationships of the four tested connections. The typical mode of failure is the shear failure of the hollow-core planks at the other end.

5. Testing Beam-hollow-core Connection by Loading the Hollow-core as Cantilever

Figure 21:
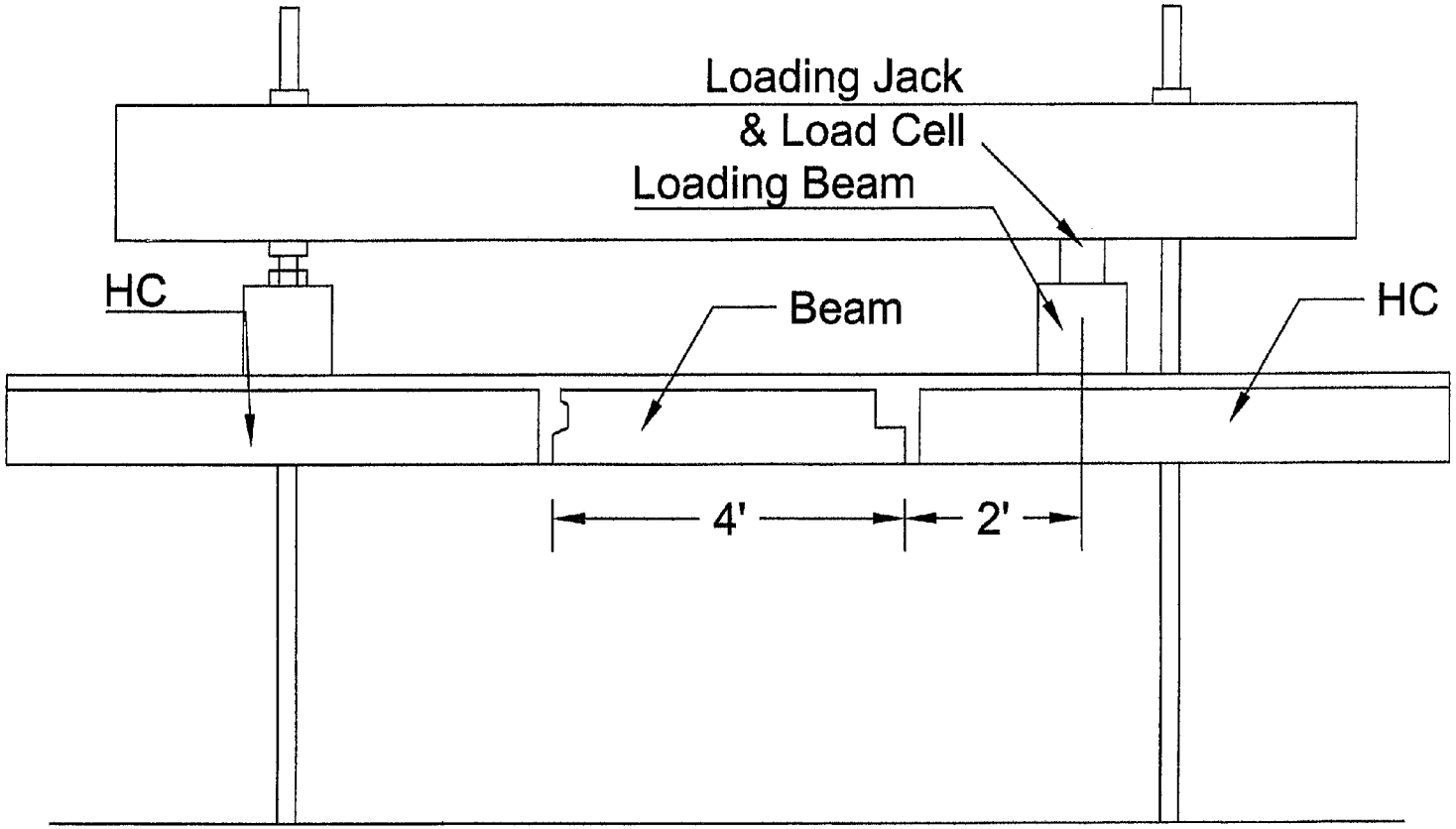
FIG. 21 is a schematic of another testing apparatus used to test the floor system of the present invention.
Figure 24:
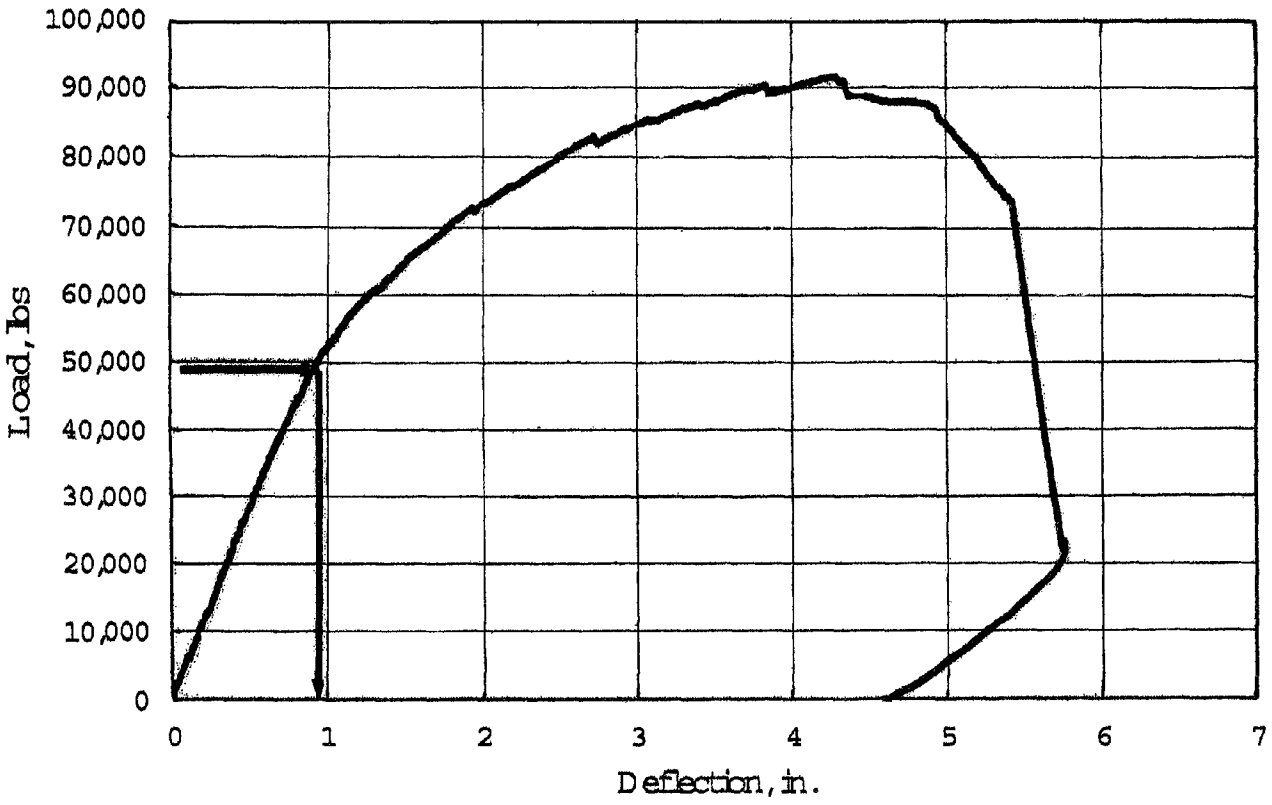
FIG. 24 is a graphical representation of the load-deflection relationship when testing the positive moment capacity at mid-section of a composite beam of the floor system of the present invention.

In the entire previous the tests were done by applied the load at the mid span of the hollow-core, and the failure occurred in the hollow-core without even cracking the connections. Therefore, in order to investigate the full shear capacity of the connection, the hollow-core was loaded as a cantilever. FIG. 21 shows the test setup, where hollow-core planks were loaded on the free end while clamping the other end to maintain specimen stability. Testing was performed to the hidden ledge connection without angle by applying a uniform load on the cantilevered hollow-core at 4 ft from the B. Testing the Beam Flexural Capacity The purpose of this test is to evaluate the positive moment capacity at the mid-section of the composite beam. One 400-kip jack was used to apply a concentrated load on the beam at 13.75 ft from the center line of roller supports, up to failure, while measuring the deflection under the load. FIG. 24 shows the load-deflection relationship. The load-deflection relationships show a linear behavior up to the cracking load, which was approximately 50 kip. This plot indicates that the beam was able to carry a load up to 91 kips, which corresponds to a positive moment capacity at the critical section of 733 kip·ft (including the moment due to the self-weight of beam, hollow-core, and topping). The ultimate positive moment due to factored dead and live loads was calculated to be 564 kip·ft (demand), which is 30% below the measured capacity. The nominal capacity of the composite beam predicted using strain compatibility approach was found to be 720 kip·ft, which is very close to the actual capacity. It should be noted that the point load equivalent to live load is approximately 49 kip and the corresponding final deflection is approximately 0.74 inch, while the allowable deflection equal to 0.93 inch.

SUMMARY AND CONCLUSIONS

The only option for constructing flat soffit shallow floors in multi-story buildings is using post-tensioned cast-in-place concrete flat slab, which is complicated, costly, and time-consuming. Current precast concrete floor systems require the use of beam ledges to support hollow core planks and column corbels to support beams, which result in projections that further reduce the clear floor height in addition to the already low span-to-depth ratio. The present floor system solves this problem by developing a shallow precast concrete floor system that eliminates the need for beam ledges and column corbels and provides a flat soffit. Economy, structural efficiency, ease and speed of construction, quality, and aesthetics are the main advantages of the proposed system. Full-scale testing of four ledge-less hollow-core-beam connections was conducted to evaluate the behaviour and shear capacity of these connections. Based on the test results, the following conclusions can be made:

1. All proposed ledge-less hollow-core-beam connections (shear key and hidden ledge with and without angles) performed very well as their shear capacity exceeded the predicted values and significantly exceeded the demand. None of these connections has failed as the tested hollow-core planks failed in shear prior to the failure of the connections 2. The capacity of the proposed ledge-less hollow-core-beam connections can be accurately predicted using shear friction theory.

3. Since the shear capacity of the hollow-core-beam connections without steel angle was adequate, steel angles are considered as temporary ledges that do not affect the fire rating of the building 4. The results of testing full-scale specimen do not only indicate the efficiency of the proposed system but also the consistency of its performance.

5. The flexural capacity of the shallow prestressed beam exceeded the demand and was accurately predicted using strain compatibility.

It should be appreciated from the foregoing description and the many variations and options disclosed that, except when mutually exclusive, the features of the various embodiments described herein may be combined with features of other embodiments as desired while remaining within the intended scope of the disclosure. It is to be understood that the above description is intended to be illustrative, and not restrictive. Many other embodiments and combinations of elements will be apparent to those skilled in the art upon reviewing the above description and accompanying drawings. The scope of the invention should, therefore, be determined with reference to the appended claims, along with the full scope of equivalents to which such claims are entitled

REFERENCES

American Concrete Institute (ACI), (2011) "Building Code Requirements for Structural Concrete and Commentary 318-11", Farmington Hills, Mich.

Bellmunt, R., and Pons, O., (2010) "NEW Precast Light Flooring System" 3rd fib International Congress, May, Washington, D.C.

Composite Dycore Office Structures, (1992) "Company literature", Finforck Industries, Inc., Orlando, Fla.

Hanlon, J. W., Dolan, C. W., Figurski, D., Deng, J., and Dolan, J. G., (2009) "Precast concrete building system components for the Westin Resort Hotel: Part 1", PCI Journal, Vol. 54, No. 2, Spring, pp. 88-96

Henin, E., Morcous G., and Tadros M., (2011) "Construction of a shallow flat soffit precast floor system" 47th ASC Annual International Conference, Omaha, Nebr.

Low, S., Tadros, M. K., and Nijhawan, J. C., (1991) "A New Framing System for Multi-story Buildings," Concrete International, Vol. 13, No. 9, September, pp. 54-57.

Low, S., Tadros, M. K., Einea, A., and Magana, R., (1996) "Seismic Behaviour of a Six Story Precast Concrete Office Building," PCI Journal, Vol. 41, No. 6, November/December, p. 56-75.

Mid-State Filigree Systems, Inc. (1992) "The Filigree Wideslab Method of concrete Deck Construction: Company Literature", Cranbury, N.J.

Morcous G., and Tadros, M. K. (2011). "Shallow Hollow-core Floor System" Technical Report, University of Nebraska-Lincoln Peikko Group, (2010) "Delta Beam Composite Beams", Peikko News, http://www.peikko.com/

Pessiki, S., Prior, R., Sause, R., and Slaughter, S., (1995) "Review of Existing precast concrete gravity load floor framing systems", PCI Journal, Vol. 40, March-April, pp. 70-83

Post-Tensioning Institute (PTI), (2006) "Post-tensioning Manual 6th Edition", Phoenix, Ariz.

Prestressed Concrete Institute (PCI), (2010) "PCI Design Handbook, 7th Edition", Chicago, Ill.

Simanjuntak, J. H. (1998) "System for Joining Precast Concrete Columns and Slabs" U.S. Pat. No. 5,809,712

Tadros, M. K., and Low, S. (1996) "Concrete Framing System" U.S. Pat. No. 5,507,124

Thompson, J. M., and Pessiki, S., (2004) "Behaviour and Design of Precast/Prestressed Inverted Tee Girders with Multiple Web Openings for Service Systems," ATLSS Report 04-07, Lehigh University, pp. 156

Wise, H. H. (1973) "Composite Concrete Construction of Two-Way Slabs and Flat Slabs" U.S. Pat. No. 3,763,613

We claim:

1. A concrete floor system, comprising:

(a) a column having a through opening at a height for support of a floor;

(b) a temporary corbel releasably secured to the column;

(c) a beam having a first end portion supported on the temporary corbel;

(d) a securement member secured to the top side of the beam and to the column;

(e) a temporary ledge releasably secured to a bottom side of the beam the beam;

(f) a floor support member supported on the temporary ledge;

(g) reinforcement interconnecting the beam and the floor support member;

(h) continuity reinforcement interconnecting the beam and the column at least some of which passes through the opening; and (i) topping concrete cast on top of the floor support member and the beam wherein when the concrete cures and the temporary corbel and the temporary ledge are removed, a flat soffit free of visible corbels is provided.

2. A concrete system as defined in claim 1, further comprising a recess formed in the top surface of the beam in which is received at least some of the continuity reinforcing.

3. A concrete system as defined in claim 2, further comprising grout filling the recess.

4. A concrete system as defined in claim 1, wherein the temporary corbel and the securement member are steel angles.

5. A concrete system as defined in claim 1, wherein the floor support member comprises a precast hollow-core concrete member.

6. A concrete system as defined in claim 1, further comprising insulation placed on top of the floor support member and the beam prior to casting of the topping concrete.

7. A concrete floor system, comprising:

(a) a column having a through opening at a height for support of a floor;

(b) a pair of temporary corbels releasably secured on opposing sides to the column below the opening;

(c) a pair of beams each having a first end portion supported on a corresponding one of the temporary corbels;

(d) a pair of securement members located on opposing sides of the column each of which secured at a first end portion to the top side of a first of the beams and secured at a second end portion to the top side of the second of the beams and each of the securement members is secured to a corresponding side of the column;

(e) temporary ledges releasably secured to a bottom side of the beam the beams;

(f) a plurality of floor support members supported on the temporary ledges;

(g) reinforcement interconnecting the beams and the associated floor support members;

(h) continuity reinforcement interconnecting the beams to each other and the column at least some of which passes through the opening; and (i) topping concrete cast on top of the floor support members and the beams wherein when the concrete cures and the temporary corbel and the temporary ledge are removed, a flat soffit free of visible corbels is provided.

8. A concrete system as defined in claim 7, further comprising a recess formed in the top surface of the beams in which is received at least some of the continuity reinforcing.

9. A concrete system as defined in claim 8, further comprising grout filling the recess.

10. A concrete system as defined in claim 7, wherein the temporary corbels and the securement members are steel angles.

11. A concrete system as defined in claim 7, wherein the floor support members comprise a precast hollow-core concrete member.

12. A concrete system as defined in claim 7, further comprising insulation placed on top of the floor support members and the beams prior to casting of the topping concrete.

13. A concrete floor system, comprising:

(a) a grid of six concrete columns comprising four exterior concrete columns and two interior concrete columns arranged in two columns and three rows and wherein each concrete column has a through opening at a height for support of a floor;

(b) a pair of temporary corbels releasably secured on opposing sides to each of the interior concrete columns below the opening and a temporary corbel attached to each of the exterior concrete columns on the interior facing side of the exterior concrete columns and below the opening;

(c) four beams each having a first end portion supported on a corresponding one the temporary corbels of the exterior columns and each having an opposite, second end portion supported on a corresponding one of the temporary corbels of the interior columns thereby providing a pair of beams spanning between each column of a first exterior concrete column, an interior concrete column and a second exterior concrete column;

(d) a securement member secured to the top side of each of the first end portions of the beams and to each of the exterior concrete columns, and a pair of securement members located on opposing sides of each of the interior concrete columns each of which is secured at a first end portion to the top side of the second end portion of each the beams corresponding to each of the interior concrete columns and secured at a second end portion to the top side of the second end portion of each of the beams corresponding to each of the interior columns, and wherein each of the securement members is secured to a corresponding side of the exterior and interior concrete columns;

(e) temporary ledges releasably secured to a bottom side of the beam the beams;

(f) a plurality of floor support members supported on the temporary ledges and spanning the distance between side-by-side adjacent beams;

(g) reinforcement interconnecting the beams and each corresponding floor support member;

(h) continuity reinforcement interconnecting the first end portions of each beam and the corresponding one of the exterior concrete columns at least some of which passes through the opening and continuity reinforcing the second portions of adjacent beams to each other and to the corresponding interior column at least some of which passes through the opening; and (i) topping concrete cast on top of the floor support members and the beams wherein when the concrete cures and the temporary corbel and the temporary ledge are removed, a flat soffit free of visible corbels is provided.

14. A concrete system as defined in claim 13, further comprising a recess formed in the top surface of the beams in which is received at least some of the continuity reinforcing.

15. A concrete system as defined in claim 14, further comprising grout filling the recess.

16. A concrete system as defined in claim 13, wherein the temporary corbels and the securement members are steel angles.

17. A concrete system as defined in claim 13, wherein the floor support members comprise a precast hollow-core concrete member.

18. A concrete system as defined in claim 13, further comprising insulation placed on top of the floor support members and the beams prior to casting of the topping concrete.

* * * * *